US009299316B2

(12) United States Patent
Saitoh et al.

(10) Patent No.: US 9,299,316 B2
(45) Date of Patent: Mar. 29, 2016

(54) DISPLAY DEVICE AND DRIVING METHOD

(75) Inventors: Kohji Saitoh, Osaka (JP); Masami Ozaki, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 311 days.

(21) Appl. No.: 13/982,573

(22) PCT Filed: Feb. 3, 2012

(86) PCT No.: PCT/JP2012/052540
§ 371 (c)(1),
(2), (4) Date: Jul. 30, 2013

(87) PCT Pub. No.: WO2012/108361
PCT Pub. Date: Aug. 16, 2012

(65) Prior Publication Data

US 2013/0307884 A1 Nov. 21, 2013

(30) Foreign Application Priority Data

Feb. 10, 2011 (JP) ..... 2011-027302

(51) Int. Cl.
*G09G 5/10* (2006.01)
*G09G 5/02* (2006.01)
*G09G 3/36* (2006.01)

(52) U.S. Cl.
CPC ..... *G09G 5/02* (2013.01); *G09G 3/3648* (2013.01); *G09G 2310/0218* (2013.01); *G09G 2320/0247* (2013.01); *G09G 2320/0257* (2013.01); *G09G 2330/021* (2013.01)

(58) Field of Classification Search
None
See application file for complete search history.

(56) References Cited

U.S. PATENT DOCUMENTS

2002/0180673 A1 12/2002 Tsuda et al.
2003/0122773 A1* 7/2003 Washio et al. ..... 345/103
2006/0214896 A1* 9/2006 Yamada et al. ..... 345/88
2009/0213042 A1* 8/2009 Hagino et al. ..... 345/55
2012/0327137 A1 12/2012 Saitoh

FOREIGN PATENT DOCUMENTS

JP 2001-312253 A 11/2001
WO 2011/114583 A1 9/2011

OTHER PUBLICATIONS

Official Communication issued in International Patent Application No. PCT/JP2012/052540, mailed on Apr. 10, 2012.

* cited by examiner

*Primary Examiner* — Christopher R Lamb
(74) *Attorney, Agent, or Firm* — Keating & Bennett, LLP

(57) ABSTRACT

The object of the present invention is to provide a display device and a driving method each of which is capable of displaying moving images without causing flicker and reducing power consumption. The display device (1) includes: a display panel (2) having a plurality of scanning signal lines (G) and a plurality of data signal lines (S); a scanning line drive circuit for scanning the plurality of scanning signal lines (G); and a signal line drive circuit (6) for supplying data signals, via the plurality of data signal lines, to pixels. In the display device 1, the plurality of scanning signal lines (G) includes a scanning signal line (Gb) for displaying a first certain color, scanning signal lines for displaying the other colors (Gr, Gg), among which the scanning signal line (Gb) is scanned least frequently than the scanning signal line (Gr) and the scanning signal line (Gg).

16 Claims, 20 Drawing Sheets

FIG. 18

(a)

| | S(1) | S(2) | S(3) | S(4) | S(5) | S(6) | | S(M-3) | S(M-2) | S(M-1) | S(M) |
|---|---|---|---|---|---|---|---|---|---|---|---|
| G1 | R | R | R | R | R | R | | R | R | R | R |
| G2 | G | G | G | G | G | G | | G | G | G | G |
| G3 | B | B | B | B | B | B | | B | B | B | B |
| G4 | R | R | R | R | R | R | | R | R | R | R |
| G5 | G | G | G | G | G | G | | G | G | G | G |
| G6 | B | B | B | B | B | B | | B | B | B | B |
| G7 | R | R | R | R | R | R | . . . | R | R | R | R |
| | | | ⋮ | | | | | | ⋮ | | |
| G(N-3) | B | B | B | B | B | B | | B | B | B | B |
| G(N-2) | R | R | R | R | R | R | | R | R | R | R |
| G(N-1) | G | G | G | G | G | G | | G | G | G | G |
| G(N) | B | B | B | B | B | B | | B | B | B | B |

(b)

| | S(1) | S(2) | S(3) | S(4) | S(5) | S(6) | | S(M-3) | S(M-2) | S(M-1) | S(M) |
|---|---|---|---|---|---|---|---|---|---|---|---|
| G1 | R | B | R | B | R | B | | R | B | R | B |
| G2 | W | G | W | G | W | G | | W | G | W | G |
| G3 | R | B | R | B | R | B | | R | B | R | B |
| G4 | W | G | W | G | W | G | | W | G | W | G |
| G5 | R | B | R | B | R | B | | R | B | R | B |
| G6 | W | G | W | G | W | G | | W | G | W | G |
| G7 | R | B | R | B | R | B | . . . | R | B | R | B |
| | | | ⋮ | | | | | | ⋮ | | |
| G(N-3) | W | G | W | G | W | G | | R | B | R | B |
| G(N-2) | R | B | R | B | R | B | | W | G | W | G |
| G(N-1) | W | G | W | G | W | G | | R | B | R | B |
| G(N) | R | B | R | B | R | B | | W | G | W | G |

DISPLAY DEVICE AND DRIVING METHOD

TECHNICAL FIELD

The present invention relates to a display device and a driving method each of which is capable of reducing power consumption.

BACKGROUND ART

Recent years have witnessed increasing use of flat, lightweight, and low power-consuming display devices such as a liquid crystal display device. Many of such display devices are employed in, for example, mobile phones, smartphones, and laptop personal computers. Furthermore, rapid development and widespread use of an electronic paper, which is a thinner display device, are expected in the future. Under such circumstances, a common object of these display devices at present is to reduce power consumption.

Patent Literature 1 discloses a display device driving method that realizes a reduction in power consumption by providing a suspension period (i) which is longer than a scanning period that is taken to scan a screen once and (ii) during which no scanning signal lines are scanned.

CITATION LIST

Patent Literature

Patent Literature 1

Japanese Patent Application Publication, Tokukai, No. 2001-312253 A (Publishing Date: Nov. 9, 2001)

SUMMARY OF INVENTION

Technical Problem

However, the technique described in Patent Literature 1 has the following problem. The technique described in Patent Literature 1 realizes a reduction in power consumption by providing a non-scanning period (i.e., suspension period) which is longer than a scanning period. That is, a non-scanning period which is longer than a scanning period is necessarily provided in a vertical period, and thus the screen is rewritten less frequently per unit time. This results in low refresh rates of pixels. If the refresh rates are low, flicker (flickering) is likely to occur on the screen depending on the characteristics of a display panel. Furthermore, since the low refresh rate means that the number of images that can be displayed in the period of one second decreases, it is not possible to display moving images smoothly. For example, a typical refresh rate is set at 60 Hz so that images are written 60 times in the period of one second. Assume here that, in the technique described in Patent Literature 1, a scanning period is one frame and a suspension period is 2 frames. In this case, the refresh rate is 20 Hz, which is one third of the typical refresh rate. This means that images are written only 20 times in the period of one second. This causes dropped frames when displaying a moving image. Therefore, according to the technique described in Patent Literature 1, it is especially difficult to display moving images.

The present invention has been made in view of the above problem, and an object of the present invention is to provide a display device and a driving method each of which is capable of displaying a moving image without flicker and is capable of reducing power consumption.

Solution to Problem

A display device in accordance with the present invention is a display device, including: a display panel having a plurality of scanning signal lines and a plurality of data signal lines; a scanning line drive circuit for sequentially selecting the plurality of scanning signal lines so as to scan the plurality of scanning signal lines; and a signal line drive circuit for supplying data signals, via the plurality of data signal lines, to pixels corresponding to a selected one of the plurality of scanning signal lines, the plurality of scanning signal lines including scanning signal lines for displaying a first certain color and scanning signal lines for displaying other color(s), and a first scanning signal line, which is at least one of the scanning signal lines for displaying the first certain color, being scanned less frequently per unit time than the scanning signal lines for displaying the other color(s).

According to this configuration, since the scanning line drive circuit operates less frequently, the scanning line drive circuit consumes less electric current. Furthermore, according to the configuration, only the scanning signal lines for displaying a certain color(s), instead of all the scanning signal lines, are scanned less frequently. Therefore, flicker (flickering) on a screen is less likely to occur, and moving images can be displayed smoothly. That is, it is possible to reduce power consumption while maintaining a high quality of moving images.

A driving method in accordance with the present invention is a method for driving a display device, the display device including (i) a display panel having a plurality of scanning signal lines and a plurality of data signal lines, (ii) a scanning line drive circuit for sequentially selecting the plurality of scanning signal lines so as to scan the plurality of scanning signal lines, and (iii) a signal line drive circuit for supplying data signals, via the plurality of data signal lines, to pixels corresponding to a selected one of the plurality of scanning signal lines, said method including: scanning the plurality of scanning signal lines, which include scanning signal lines for displaying a first certain color and scanning signal lines for displaying other color(s), such that a first scanning signal line, which is at least one of the scanning signal lines for displaying the first certain color, is scanned less frequently per unit time than the scanning signal lines for displaying the other color(s).

According to this arrangement, since the scanning line drive circuit operates less frequently, the scanning line drive circuit consumes less electric current. Furthermore, according to the arrangement, only the scanning signal lines for displaying a certain color(s), instead of all the scanning signal lines, are scanned less frequently. Therefore, flicker (flickering) on a screen is less likely to occur, and moving images can be displayed smoothly. That is, it is possible to reduce power consumption while maintaining a high quality of moving images.

Advantageous Effects of Invention

According to a display device and a driving method of the present invention, it is possible to display a moving image without flicker and to reduce power consumption.

BRIEF DESCRIPTION OF DRAWINGS

FIG. 18 is a view illustrating how colors to be displayed in pixels are arranged in a display panel 2 of the display device 1.

DESCRIPTION OF EMBODIMENTS

The following description will discuss, with reference to the drawings, one embodiment of the present invention.

Embodiment 1

Figure 1:
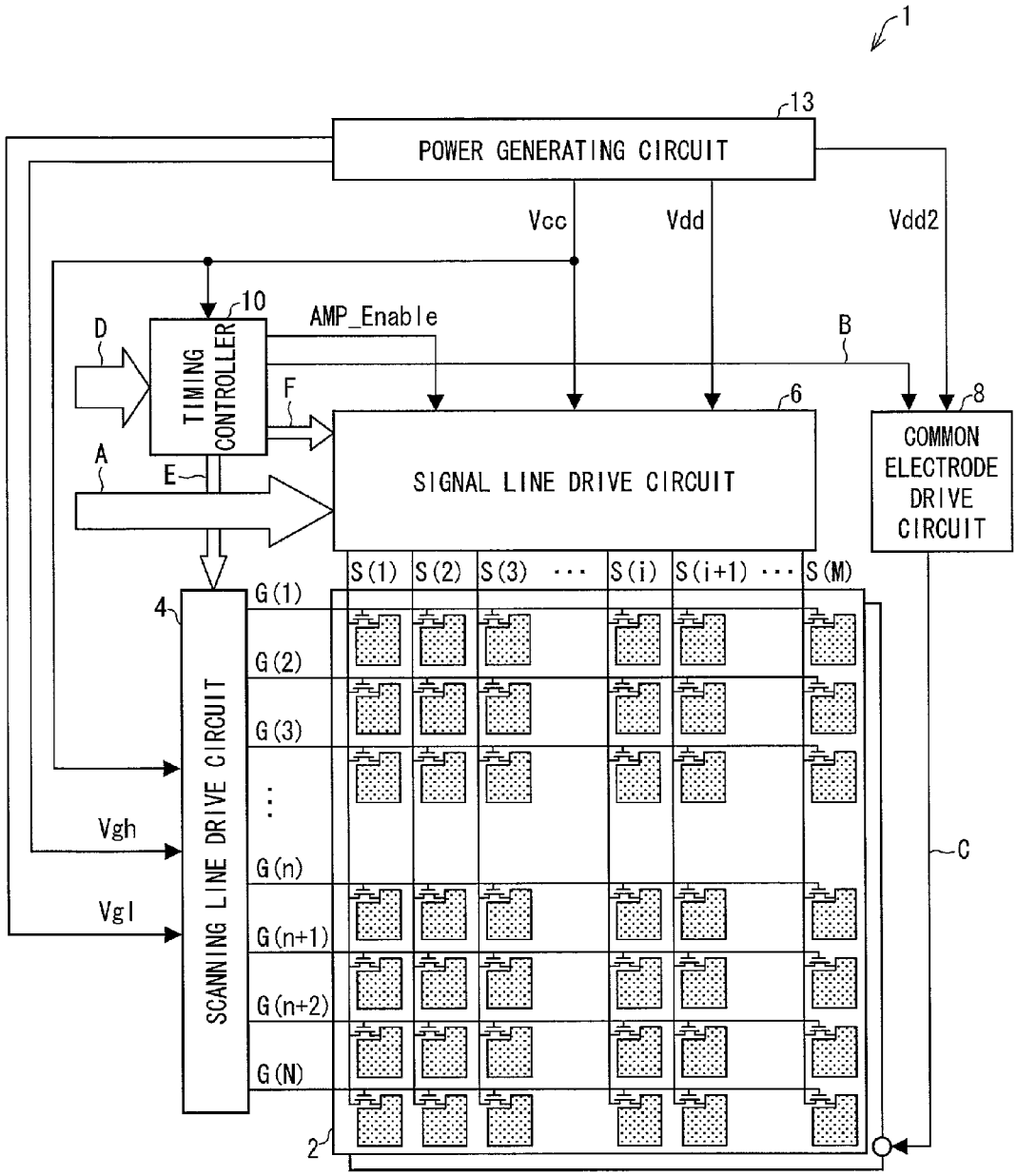
FIG. 1 is a view illustrating an overall configuration of a display device 1 in accordance with Embodiment 1.

First, Embodiment 1 of the present invention will be described. A configuration of a display device (liquid crystal display device) 1 in accordance with Embodiment 1 is described with reference to FIG. 1. FIG. 1 is a view illustrating an overall configuration of the display device 1 in accordance with Embodiment 1. As shown in FIG. 1, the display device 1 includes a display panel 2, a scanning line drive circuit (gate driver) 4, a signal line drive circuit (source driver) 6, a common electrode drive circuit 8, a timing controller 10, and a power generating circuit 13.

The display panel 2 includes: a screen constituted by a plurality of pixels arranged in a matrix manner; N (N is any integer) scanning signal lines G (gate lines) which are to be selected sequentially so that the screen is scanned line by line; and M (M is any integer) data signal lines S (source lines) via which data signals are supplied to a row of pixels corresponding to a selected one of the scanning signal lines. The scanning signal lines G and the data signal lines S intersect each other.

Hereinafter, the n-th (n is any integer) scanning signal line G is indicated as G(n). For example, G(1), G(2), and G(3) indicate the first, second, and third scanning signal lines G, respectively. Furthermore, the i-th (i is any integer) data signal line S is hereinafter indicated as S(i). For example, S(1), S(2), and S(3) indicate the first, second, and third data signal lines S, respectively.

Each of the scanning signal lines G is connected with a plurality of pixels for displaying a certain color. For example, in Embodiment 1, the first scanning signal line G(1) is a scanning signal line connected with a plurality of pixels for displaying red, which pixels are arranged in a line along a lateral direction (such a scanning signal line is hereinafter referred to as a "scanning signal line Gr"). Furthermore, the second scanning signal line G(2) is a scanning signal line connected with a plurality of pixels for displaying green, which pixels are arranged in a line along the lateral direction (such a scanning signal line is hereinafter referred to as a "scanning signal line Gg") Furthermore, the third scanning signal line G(3) is a scanning signal line connected with a plurality of pixels for displaying blue, which pixels are arranged in a line along the lateral direction (such a scanning signal line is hereinafter referred to as a "scanning signal line Gb"). Also in the rest of the display panel 2, a plurality of scanning signal lines G are arranged in repeating patterns of three lines with a scanning signal line Gr first, a scanning signal line Gg second and a scanning signal line Gb third. In other words, in the display panel 2 of Embodiment 1, color filters are arranged in a horizontal striped pattern.

The scanning line drive circuit 4 scans the scanning signal lines G sequentially from top to bottom of the screen line by line. The scanning line drive circuit 4 sequentially supplies voltages to the scanning signal lines G so that switching elements (TFTs) included in respective pixels corresponding to a selected one of the scanning signal lines G are turned on. In this way, the scanning line drive circuit 4 sequentially selects the scanning signal lines G so as to scan the scanning signal lines G.

The signal line drive circuit 6 supplies data signals, which serve as image data, to pixels corresponding to a selected one of the scanning signal lines G via the data signal lines S. Specifically, the signal line drive circuit 6 (i) calculates, on the basis of an inputted image signal (arrow A), values of voltages to be supplied to the pixels corresponding to the selected one of the scanning signal lines G, and (ii) outputs calculated voltages to the data signal lines S. As a result, the pixels corresponding to the selected one of the scanning signal lines G are supplied with image data.

The display device 1 includes a common electrode (not illustrated) which is provided so as to correspond to pixels in the screen. The common electrode drive circuit 8 supplies, in response to a signal (arrow B) received from the timing controller 10, a predetermined common voltage to the common electrode in order to drive the common electrode.

The timing controller 10 supplies signals to the above-mentioned circuits. The signals serve as references according to which the circuits operate in synchronization with each other. Specifically, the timing controller 10 supplies, to the scanning line drive circuit 4, a gate start pulse signal, a gate clock signal GCK, and a gate output control signal GOE (arrow E). The timing controller 10 further supplies, to the signal line drive circuit 6, a source start pulse signal, a source latch strobe signal, and a source clock signal (arrow F).

The scanning line drive circuit 4 starts scanning of the display panel 2 upon receipt of the gate start pulse signal from the timing controller 10, and sequentially applies selective voltages to the scanning signal lines G in response to gate clock signals GCK and gate output control signals GOE received from the timing controller 10. This is specifically described as follows. That is, the scanning line drive circuit 4 sequentially selects the scanning signal lines G in response to the gate clock signals GCK which it received. Furthermore, the scanning line drive circuit 4 applies, when it has detected a trailing edge of a received output control signal GOE, a selective voltage to a selected one of the scanning signal lines G. In this way, the scanning line drive circuit 4 scans the selected one of the scanning signal lines G.

The signal line drive circuit 6 (i) stores, upon receipt of the source start pulse signal from the timing controller 10, inputted image data for the pixels in a register in accordance with the source clock signal and (ii) supplies, in response to the source latch strobe signal which comes next, the image data to the data signal lines S of the display panel 2.

The power generating circuit 13 generates Vdd, Vdd2, Vcc, Vgh, and Vgl which are voltages necessary for the above-mentioned circuits in the display device 1 to operate. The power generating circuit 13 then supplies Vcc, Vgh, and Vgl to the scanning line drive circuit 4, Vdd and Vcc to the signal line drive circuit 6, Vcc to the timing controller 10, and Vdd2 to the common electrode drive circuit 8.

(Conventional Display Operation)

Figure 2:
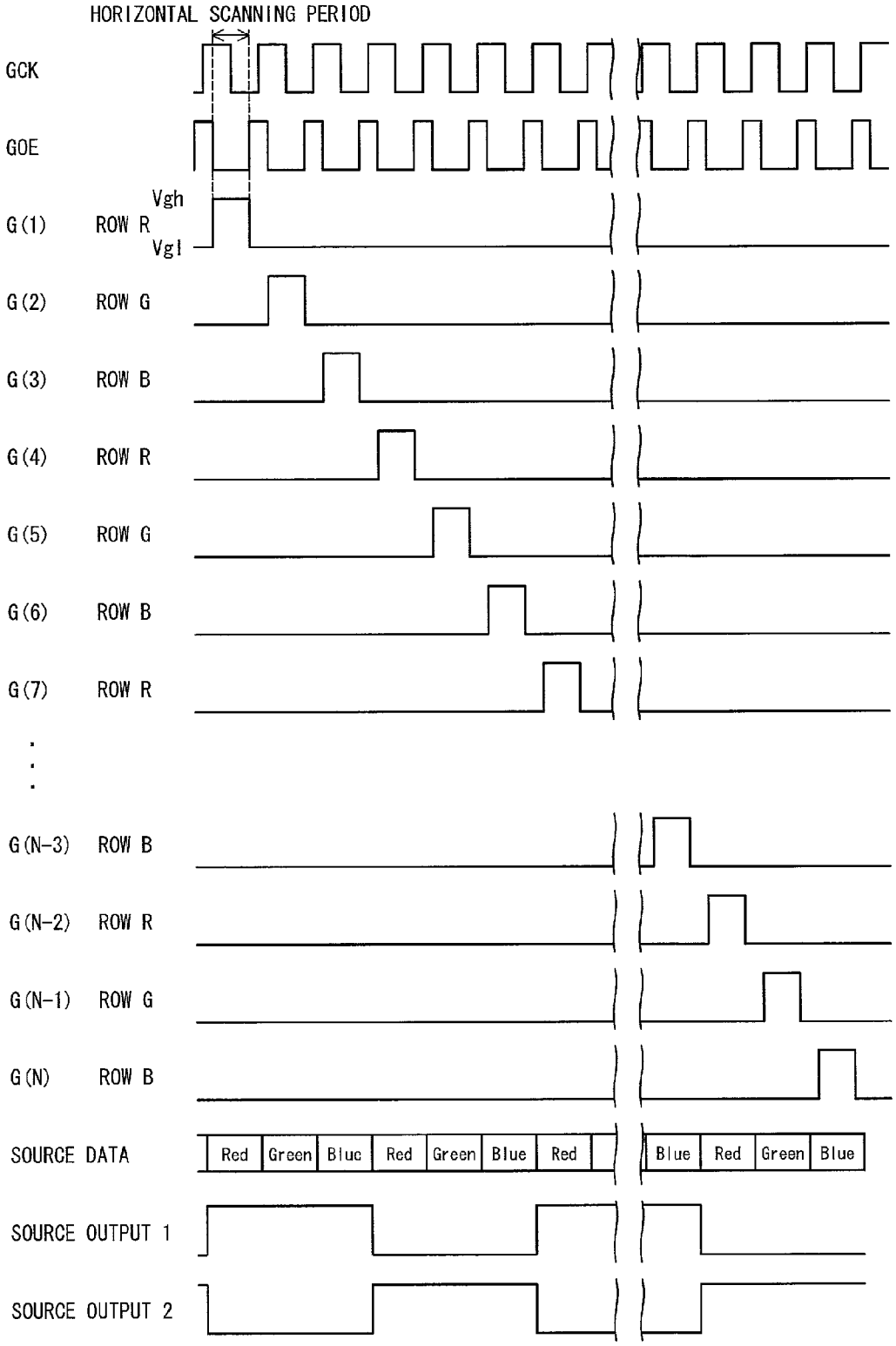
FIG. 2 is a view illustrating signal waveforms for a conventional display operation.

The following description will discuss a conventional display operation. The following description deals with an example in which the display device 1 illustrated in FIG. 1 carries out a conventional display operation. FIG. 2 is a view illustrating signal waveforms for the conventional display operation.

As shown in FIG. 2, the timing controller 10 supplies a gate output control signal GOE to the scanning signal drive circuit 4 every horizontal scanning period.

In the first horizontal scanning period, the scanning line drive circuit 4 changes a voltage to be applied to the first scanning signal line G from Vgl (low level) to Vgh (high level) in synchronization with the gate output control signal GOE. This causes gates of TFTs in pixels connected to the scanning signal line G(1) to be turned on.

Meanwhile, in the first horizontal scanning period, the signal line drive circuit 6 supplies, in synchronization with the gate output control signal GOE, data signals to the data signal lines S(i) via analog amplifiers connected with the respective signal lines S(i). This causes voltages necessary for a display to be supplied to the data signal lines S and be written to pixel electrodes via corresponding TFTs.

For example, when the first scanning signal line G(1) is in a selected state, the signal line drive circuit 6 applies, to pixel electrodes in pixels for displaying red which are connected with the first scanning signal line G(1), voltages necessary for a display. These voltages are based on image data corresponding to the first scanning signal line G(1).

After the end of the first horizontal period, the scanning line drive circuit 4 receives a next gate output control signal GOE. Rows of pixels connected with the second and subsequent scanning signal lines G are each driven in the same manner as a row of pixels connected with the first scanning signal line G.

Note, here, that the display device 1 drives the display panel 2 by reverse polarity driving. Therefore, polarity of a voltage to be applied to the data signal lines S(i) is reversed for every predetermined number of scanning signal lines. According to the display device 1 of Embodiment 1, polarity of a voltage to be applied to the data signal lines S(i) is reversed for every three (RGB) scanning signal lines. For example, as shown in FIG. 2, data signals having a positive polarity are applied to the data signal lines S(i) during horizontal scanning periods in which the first to third scanning signal lines G(1) to G(3) are scanned, and data signals having a negative polarity are applied to the data signal lines S(i) during horizontal periods in which fourth to sixth scanning signal lines G(4) to G(6) are scanned.

The display device 1 repeats the foregoing processes, thereby sequentially scanning the first to last scanning signal lines G within one frame period (one vertical scanning period). One (1) rewriting of a screen is thus carried out by the display device 1. Since a refresh rate in the display device 1 is 60 Hz, the display device 1 rewrites the screen 60 times in the period of one second.

(Display Operation by Display Device 1)

Figure 3:
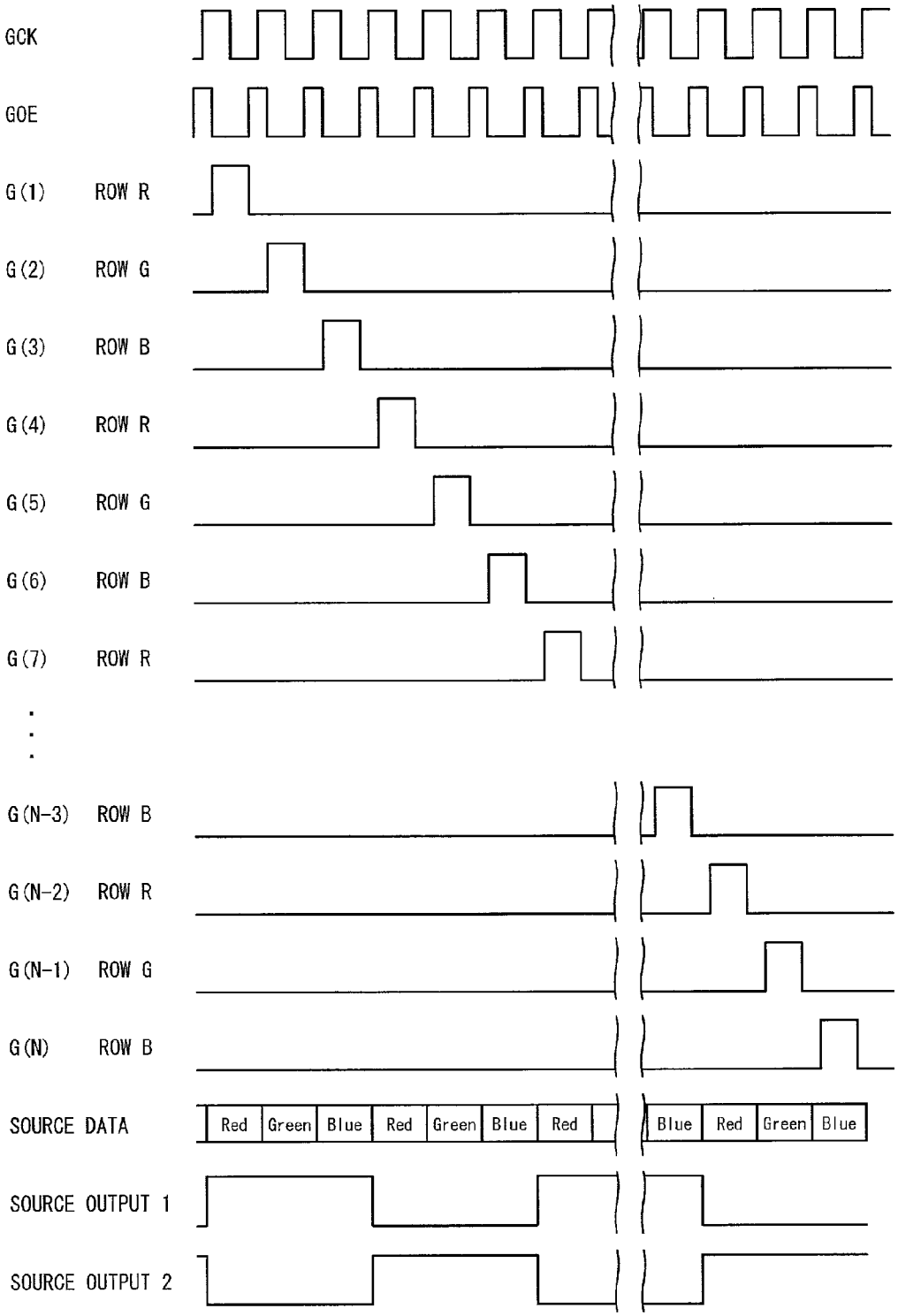
FIG. 3 is a view illustrating signal waveforms for a display operation carried out by the display device 1 in accordance with Embodiment 1.
Figure 4:
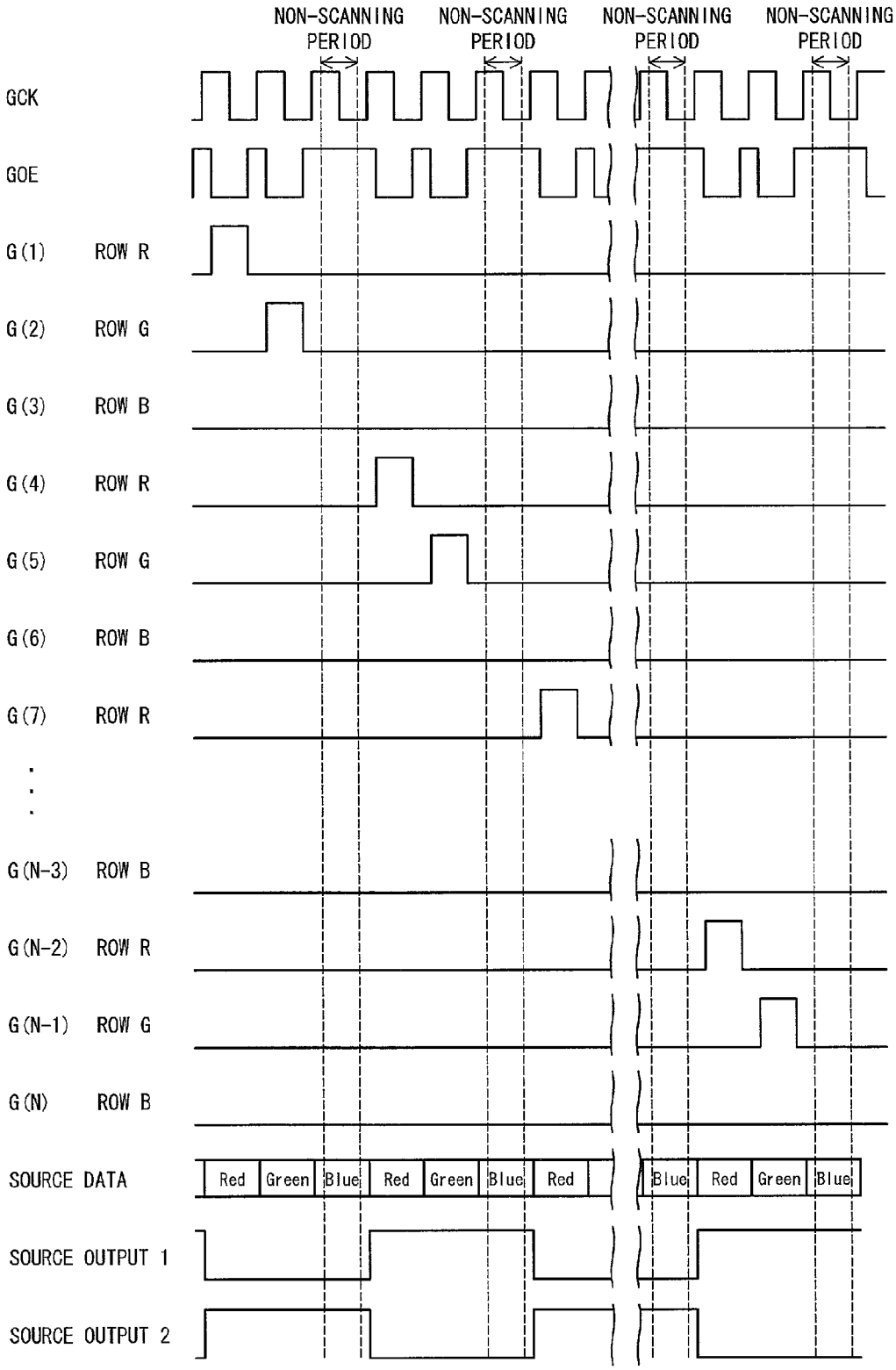
FIG. 4 is a view illustrating signal waveforms for the display operation carried out by the display device 1 in accordance with Embodiment 1.

The following description discusses a display operation carried out by the display device 1 in accordance with Embodiment 1. FIGS. 3 and 4 are views illustrating signal waveforms for a display operation carried out by the display device 1 in accordance with Embodiment 1. FIG. 3 is a view illustrating signal waveforms in an even-numbered frame period. FIG. 4 is a view illustrating signal waveforms in an odd-numbered frame period.

(Reducing the Number of Times Scanning is Carried Out)

A display operation carried out by the display device 1 of Embodiment 1 is different from a display operation described with reference to FIG. 2 in that scanning signal lines for a certain color are scanned less frequently than scanning signal line for other color(s). For example, in Embodiment 1, the scanning signal lines Gb are scanned less frequently than the scanning signal lines Gr and the scanning signal lines Gg.

Specifically, in an even-numbered frame period, the scanning line drive circuit 4 carries out scanning of all the scanning signal lines Gr, the scanning signal lines Gg, and the scanning signal lines Gb (see FIG. 3). On the other hand, in an odd-numbered scanning period, the scanning line drive circuit 4 (i) carries out scanning of the scanning signal lines Gr and the scanning signal lines Gg in the same manner as in the even-numbered frame but (ii) does not carry out scanning of the scanning signal lines Gb (see FIG. 4). That is, there are provided horizontal scanning periods during which the scanning signal lines Gb are not scanned (such a horizontal scanning period is hereinafter referred to as a "non-scanning period"). With this configuration, in the display device 1 of Embodiment 1, the scanning signal lines Gb are scanned half as frequently as the scanning signal lines Gr and the scanning signal lines Gg. Since a refresh rate for the scanning signal lines Gr and the scanning signal lines Gg in the display device 1 of Embodiment 1 is 60 Hz, a refresh rate for the scanning signal lines Gb is 30 Hz.

As described earlier, the scanning line drive circuit 4 selects a next scanning signal line upon receipt of a gate clock signal GCK from the timing controller 10. Then, upon receipt of a gate output control signal GOE from the timing controller 10, the scanning line drive circuit 4 starts scanning of a selected scanning signal line (the next scanning line). Specifically, the scanning line drive circuit 4 starts scanning of the next scanning signal line upon detecting a trailing edge of the gate output control signal GOE.

That is, in order to cause the scanning line drive circuit 4 not to scan a certain scanning signal line (in Embodiment 1, the scanning signal lines Gb), it is only necessary that, while the certain scanning signal line is in a selected state, the timing controller 10 supply a gate output control signal GOE fixed at high level to the scanning line drive circuit 4.

To this end, the display device 1 of Embodiment 1 is configured such that, during a non-scanning period, a gate output control signal GOE that never falls is supplied from the timing controller 10 to the scanning line drive circuit 4. With this configuration, the display device 1 of Embodiment 1 controls the scanning line drive circuit 4 so that the scan scanning signal lines Gb are not scanned during the non-scanning periods.

(Reducing Performance of Signal Line Drive Circuit 6)

As described earlier, according to the display device 1 of Embodiment 1, the scanning signal lines Gb are not scanned during the non-scanning periods. Therefore, it is not necessary that the signal line drive circuit 6 be operated during the non-scanning periods. In view of this, the display device 1 of Embodiment 1 is configured such that, for the purpose of further reducing its power consumption, the signal line drive circuit 6 is stopped or performance of the signal line drive circuit 6 is reduced during the non-scanning periods.

For example, the signal line drive circuit 6 includes, for the respective data signal lines S, analog amplifiers for applying voltages to the data signal lines S. In other words, in a case where a resolution of the display device 1 is 1366×768 for example, the signal line drive circuit 6 includes 1366 analog amplifiers.

According to the display device 1 of Embodiment 1, during the non-scanning periods, the scanning signal lines Gb are not scanned and the analog amplifiers are not operated.

Each of the analog amplifiers is switched between operating and non-operating states in response to switching between high level and low level of a control signal supplied from the timing controller 10. Therefore, in the display device 1, the performance of each of the analog amplifiers can be reduced (each of the analog amplifiers can be caused to be in the non-operating state) by changing, from the high level to the low level, the level of a control signal supplied from the timing controller 10 to each of the analog amplifier.

Note that the display device 1 of Embodiment 1 is configured such that polarities of voltages applied to the data signal lines S(i) are reversed also for every frame period (every one vertical scanning period). For example, in an even-numbered frame period, data signals having a positive polarity are applied to the data signal lines S(i) during horizontal scanning periods in which the first to third scanning signal lines G(1) to G(3) are scanned (see FIG. 3). On the other hand, in an odd-numbered frame period, data signals having a negative polarity are applied to the data signal lines S(i) during horizontal scanning periods in which the first to third scanning signal lines G (1) to G(3) are scanned (see FIG. 4).

(Power-Saving Effect)

The following description will discuss power-saving effect brought about by the display device 1 of Embodiment 1. The following description deals with an example in which a resolution of the display device 1 is 1366×768.

First, the following describes how much power is consumed when the display device 1 is caused to carry out a conventional display operation described with reference to FIG. 2.

The display device 1 includes the analog amplifiers for the respective data signal lines S. This means that the signal line drive circuit 6 includes 1366 analog amplifiers. Each of the analog amplifiers is an element to supply a data signal to a corresponding one of the data signal lines. Note here that each of the analog amplifiers consumes approximately 5 μA of electric current. That is, the sum of electric current consumed by the 1366 analog amplifiers is approximately 6.8 mA. Usually, the signal line drive circuit 6 is supplied with a voltage (Vdd) of approximately 13 V. Therefore, the signal line drive circuit 6 consumes electric power of 13V×6.8 mA=approximately 88 mW.

Furthermore, the display device 1 includes analog amplifiers also for the respective scanning signal lines G. This means that the scanning line drive circuit 4 includes 768 analog amplifiers. Each of the analog amplifiers is an element to supply, to a corresponding one of the scanning signal lines, a control voltage to control switching elements. Note here that each of the analog amplifiers consumes approximately 0.4 μA of electric current. Therefore, the sum of electric current consumed by the 768 analog amplifiers is approximately 0.3 mA. Usually, a voltage (Vgh) supplied to the scanning line drive circuit 4 is approximately 15 V. Furthermore, usually, voltage (Vgl) supplied to the scanning line drive circuit 4 is approximately −12V. That is, amplitude of voltages (difference between Vgh and Vgl) supplied to the scanning line drive circuit 4 is approximately 27 V. Therefore, the scanning line drive circuit 4 consumes electric power of 27 V×0.3 mA=approximately 8.1 mW.

The electric power consumed by the signal line drive circuit 6 and the scanning line drive circuit 4 accounts for a substantial proportion of power consumed by the display device 1 as a whole. This is one of the major causes that hinders power saving of the display device 1.

The following description discusses how much power is consumed when the display device 1 is caused to carry out a display operation in accordance with Embodiment 1 of the present invention described with reference to FIGS. 3 and 4.

As has been described, according to the display device 1 of Embodiment 1, the scanning line drive circuit 4 and the signal line drive circuit 6 are not operating during the non-scanning periods. The non-scanning periods account for one third of all the horizontal scanning periods included in the odd-numbered frame periods which account for one half of all the frame periods.

This reduces power consumed by the signal line drive circuit 6 by 88 mW×⅓×½=approximately 14.7 mW. That is, power consumed by the signal line drive circuit 6 is 88 mW−14.7 mW=73.3 mW. In this way, the display device 1 of Embodiment 1 achieves power saving of approximately 16.7% in the signal line drive circuit 6.

Similarly, power consumed by the scanning line drive circuit 4 is reduced by 8.1 mW×⅓×½=approximately 1.4 mW. That is, power consumed by the scanning line drive circuit 4 is 8.1 mW−1.4 mW=6.7 mW. In this way, the display device 1 of Embodiment 1 achieves power saving of approximately 16.7% in the scanning line drive circuit 4.

(Operation and Effect)

As has been described, the display device 1 of Embodiment 1 is configured such that scanning signal lines for displaying a certain color are scanned less frequently than scanning signal lines for displaying other colors. Since the display device 1 of Embodiment 1 is configured like above, the display device 1 achieves greater power saving than a conventional display device that does not have such a configuration, as described above.

Note that the display device 1 of Embodiment 1 is configured such that only the scanning signal lines for displaying the certain color, instead of all the scanning signal lines, are scanned less frequently. Since the display device 1 of Embodiment 1 is configured like above, in the display device 1, flicker (flickering) on a screen is less likely to occur and moving images are displayed more smoothly, than a conventional display device which is configured such that all the scanning signal lines are scanned less frequently. That is, according to the display device 1 of Embodiment 1, it is possible to reduce power consumption while maintaining a high quality of moving images.

In particular, the display device 1 of Embodiment 1 is configured such that the scanning signal lines Gb for displaying blue (blue has the lowest luminance ratio among red (R), green (G), and blue (B)) are scanned less frequently. According to the display device 1 of Embodiment 1 configured like above, less luminance change occurs and thus flicker (flickering) on a screen is less likely to occur, as compared to a display device configured such that scanning signal lines for displaying a color other than blue are scanned less frequently. Furthermore, awkward movement of a moving image, which results from a reduction in the number of times of scanning is carried out, is less perceivable by a viewer. That is, according to the display device 1 of Embodiment 1, it is possible to reduce power consumption while maintaining a high quality of moving images.

Furthermore, the display device 1 of Embodiment 1 is configured such that performance of the signal line drive circuit 6 is reduced during horizontal scanning periods in which the scanning signal lines Gb are not scanned. According to the display device 1 of Embodiment 1 configured like above, it is possible to achieve greater power saving than a display device without such a configuration. Note that, since the above horizontal scanning periods are periods during which the screen is not rewritten, there is no impact on a quality of moving images even in a case where the configuration is employed.

Furthermore, according to the display device 1 of Embodiment 1, the scanning signal lines Gb are caused to be scanned less frequently than the scanning signal lines Gr and the scanning signal lines Gg by providing frame periods during which the scanning signal lines Gb are not scanned. That is, the number of times the scanning signal lines Gb are scanned is reduced by not scanning the scanning signal lines Gb during the above frame periods. As such, it is possible to cause the scanning signal lines Gb to be scanned less frequently, merely by employing a simple configuration in which waveforms of control signals (in Embodiment 1, gate output control signals GOE) for scanning the scanning signal lines Gb are different from those of control signals for scanning the scanning signal lines Gr and the scanning signal lines Gg. For example, it is possible to realize the configuration, in which the scanning signal lines Gb are scanned less frequently, at a lower cost than other configurations such as a configuration in which frame periods for the scanning signal lines Gb are different in length from those for the scanning signal lines Gr and the scanning signal lines Gg.

Embodiment 2

Next, Embodiment 2 of the present invention will be described. In Embodiment 1, the scanning signal lines Gb are scanned less frequently than the scanning signal lines Gr and the scanning signal lines Gg. Specifically, in Embodiment 1, the scanning signal lines Gr and the scanning signal lines Gg are each scanned 60 times, whereas the scanning signal lines Gb are scanned 30 times.

In Embodiment 2, the scanning signal lines Gr are also scanned less frequently than the scanning signal lines Gg. Specifically, in Embodiment 2, the scanning signal lines Gg are scanned 60 times, the scanning signal lines Gr are scanned 40 times, and the scanning signal lines Gb are scanned 30 times.

Note that, since a configuration of a display device 1 of Embodiment 2 is the same as that of the display device 1 of Embodiment 1, its description is omitted here. However, a display operation carried out by the display device 1 of Embodiment 2 is different in some points from that carried out by the display device 1 of Embodiment 1. Therefore, the differences between the display operation carried out by the display device 1 of Embodiment 2 and that carried out by the display device 1 of Embodiment 1.

(Display Operation by Display Device 1)

Figure 5:
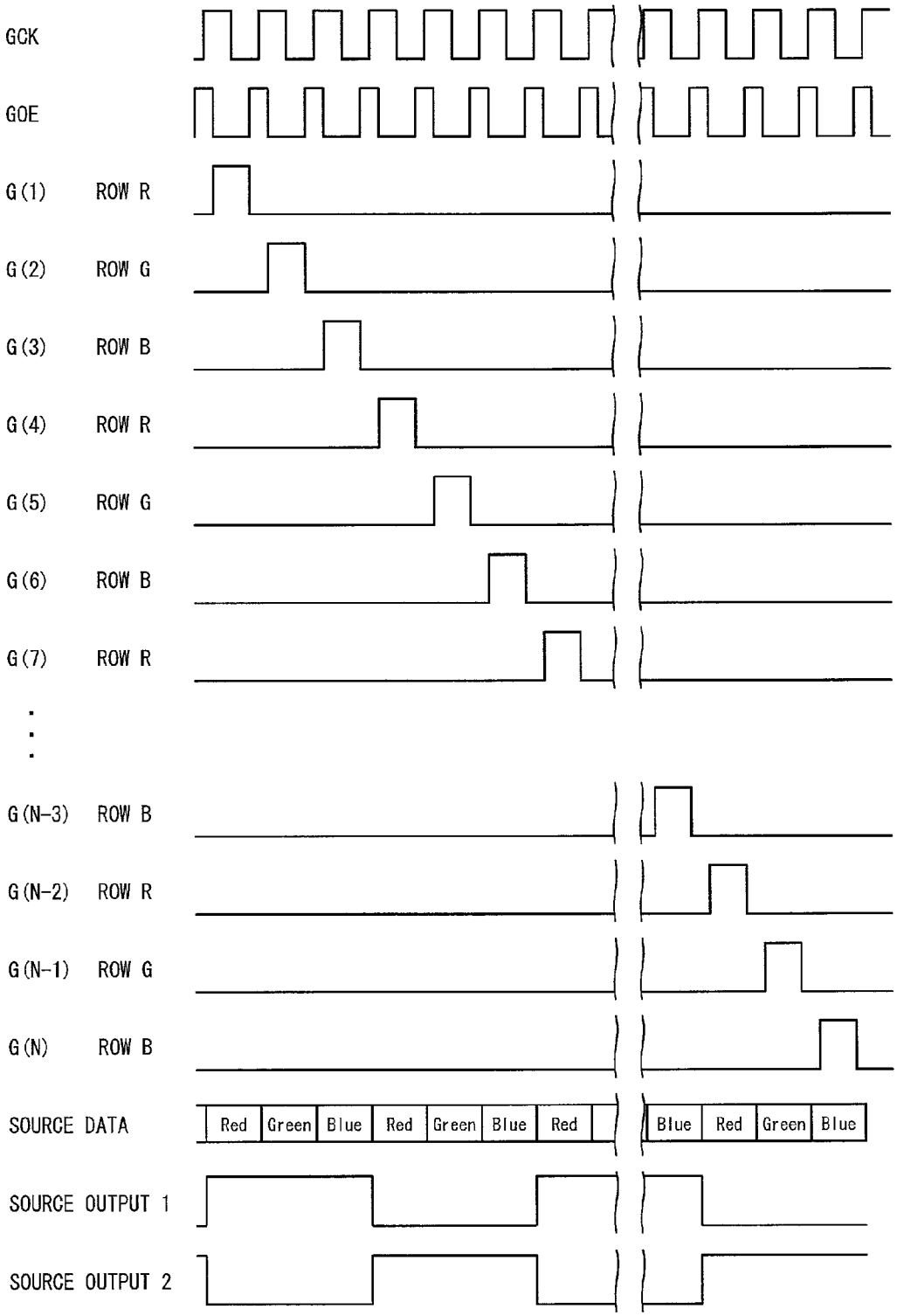
FIG. 5 is a view illustrating signal waveforms for a display operation carried out by a display device 1 in accordance with Embodiment 2.
Figure 6:
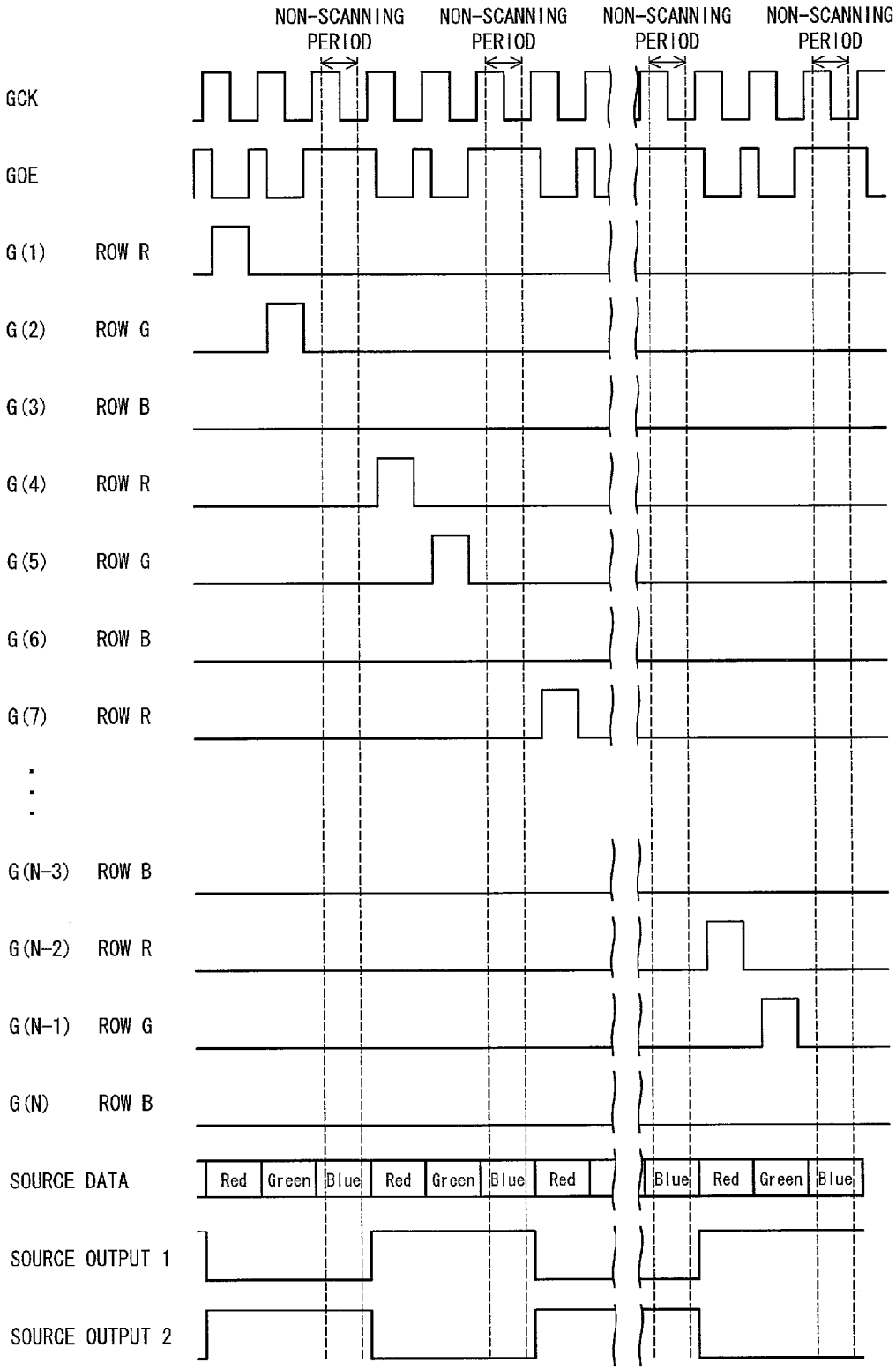
FIG. 6 is a view illustrating signal waveforms for the display operation carried out by the display device 1 in accordance with Embodiment 2.
Figure 7:
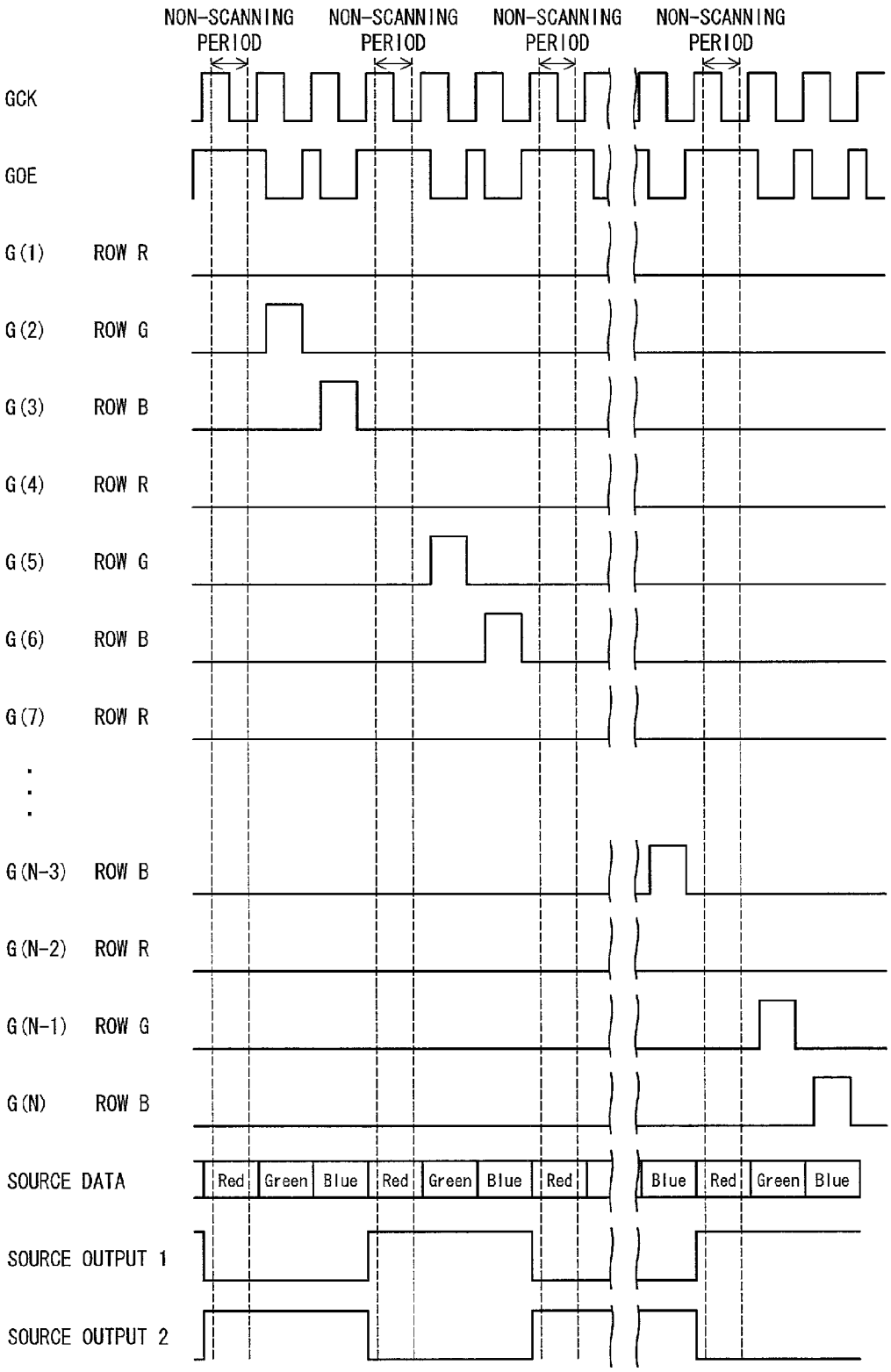
FIG. 7 is a view illustrating signal waveforms for the display operation carried out by the display device 1 in accordance with Embodiment 2.
Figure 8:
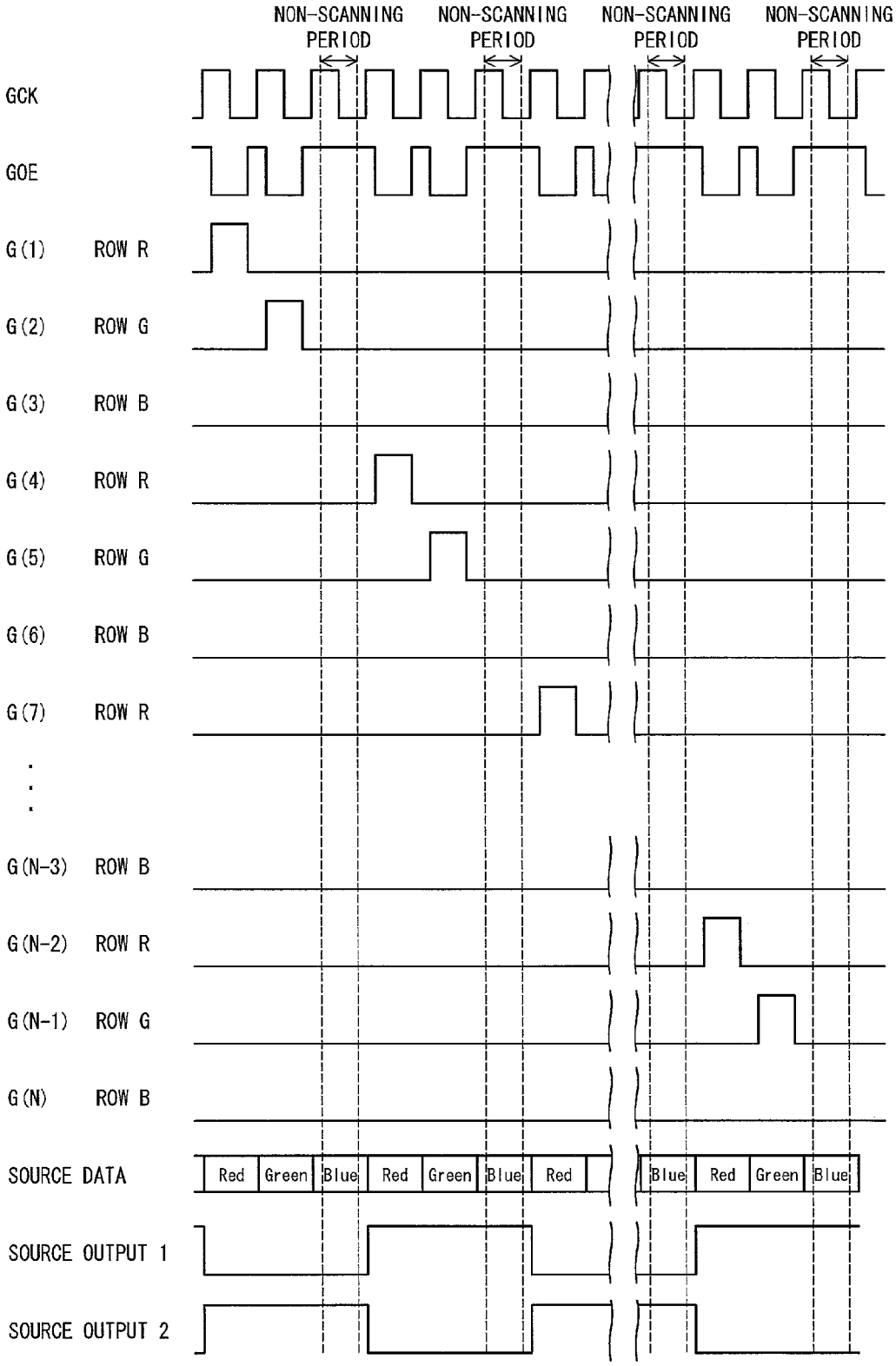
FIG. 8 is a view illustrating signal waveforms for the display operation carried out by the display device 1 in accordance with Embodiment 2.
Figure 9:
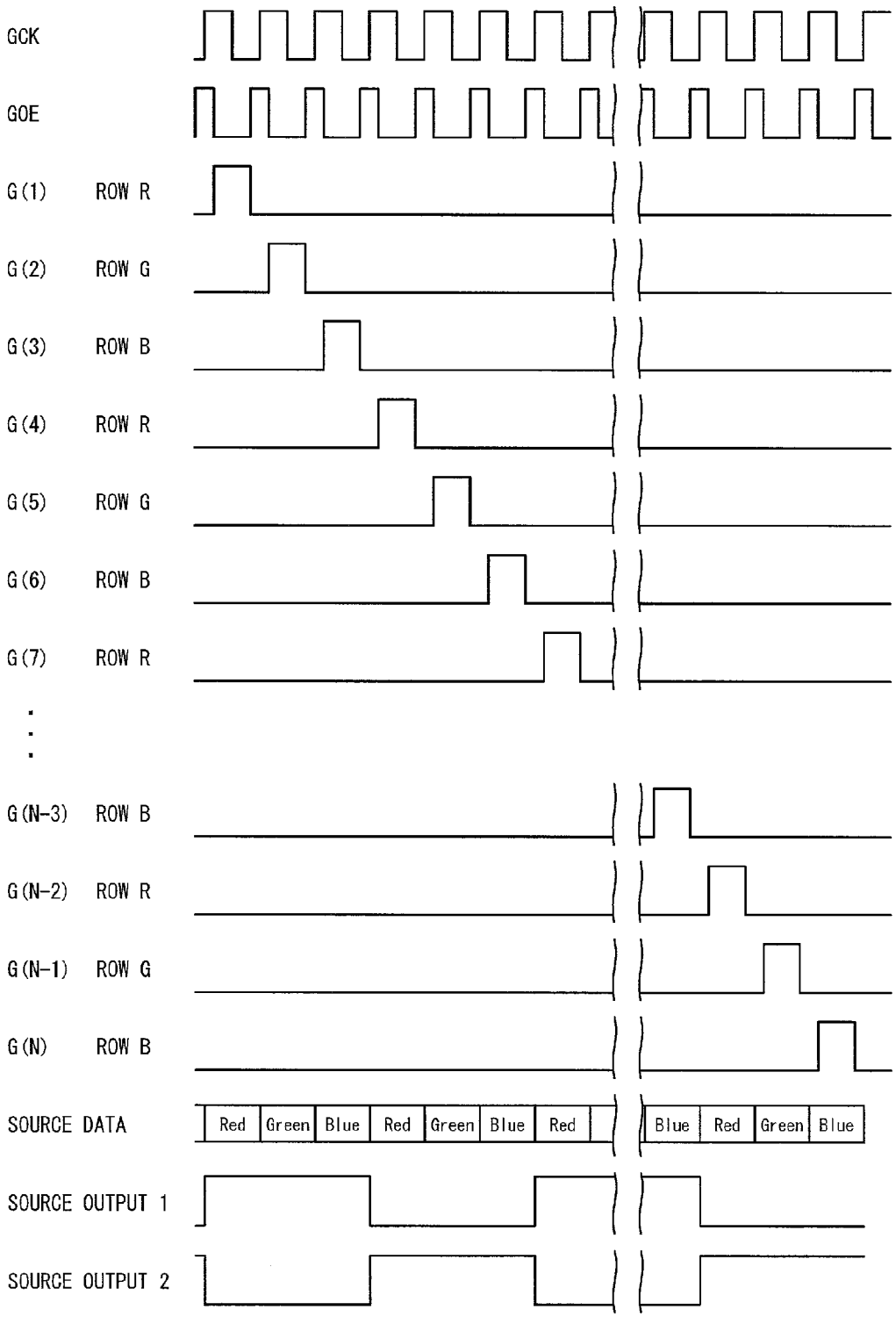
FIG. 9 is a view illustrating signal waveforms for the display operation carried out by the display device 1 in accordance with Embodiment 2.
Figure 10:
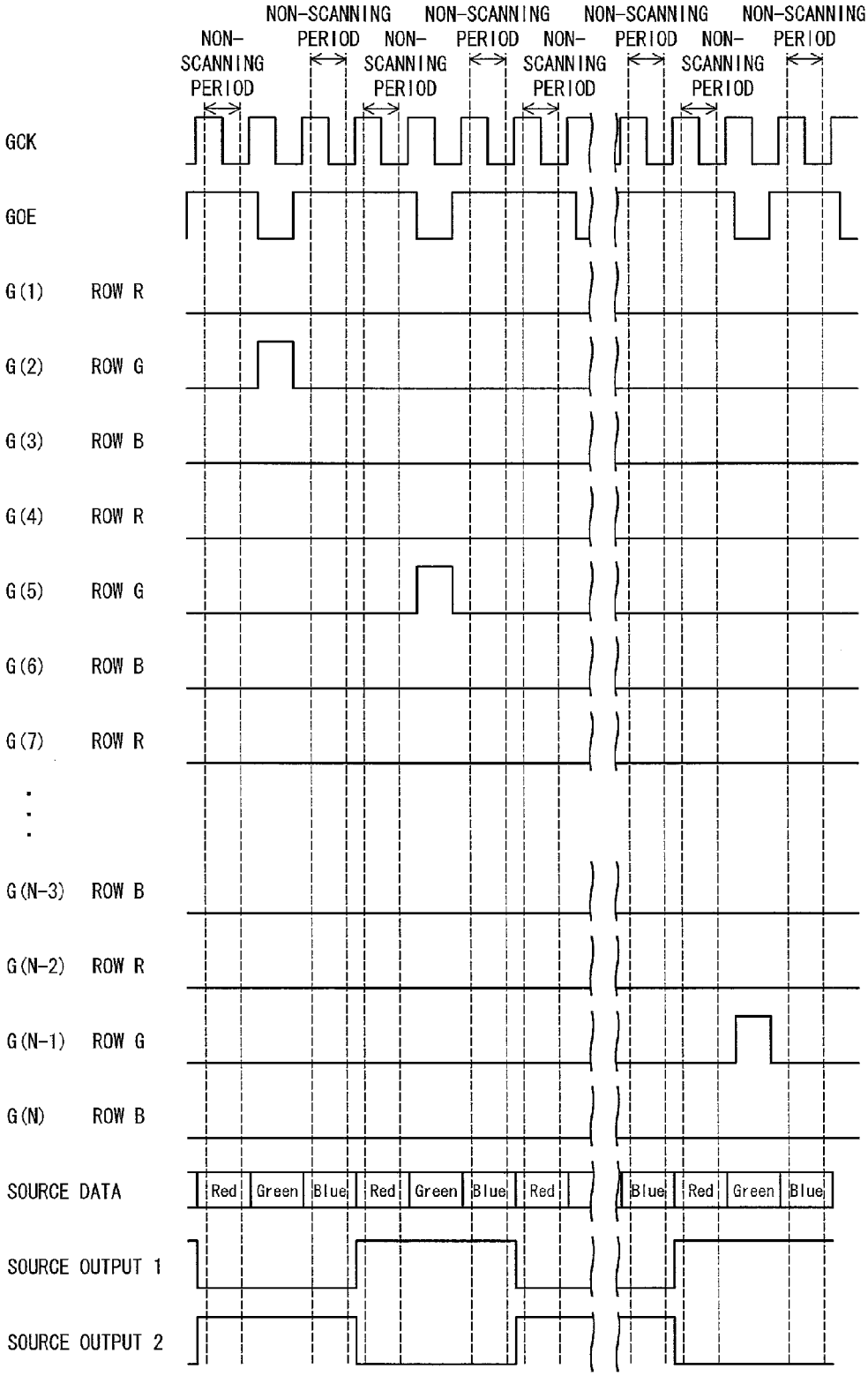
FIG. 10 is a view illustrating signal waveforms for the display operation carried out by the display device 1 in accordance with Embodiment 2.

FIGS. 5 through 10 are views illustrating signal waveforms for a display operation carried out by the display device 1 in accordance with Embodiment 2. FIG. 5 is a view illustrating signal waveforms in a first frame period. FIG. 6 is a view illustrating waveforms in a second frame period. FIG. 7 is a view illustrating waveforms in a third frame period. FIG. 8 is a view illustrating waveforms in a fourth frame period. FIG. 9 is a view illustrating waveforms in a fifth frame period. FIG. 10 is a view illustrating waveforms in a sixth frame period.

(Reducing the Number of Times Scanning is Carried Out)

The display device 1 of Embodiment 2 is different from the display device 1 of Embodiment 1 in that, of the scanning signal lines for the other colors which are not caused to be scanned less frequently in Embodiment 1, scanning signal lines for another certain color are scanned less frequently than the scanning signal lines for the rest of the other colors. For example, in Embodiment 1, the scanning signal lines Gb are scanned less frequently than the scanning signal lines Gr and the scanning signal lines Gg. In Embodiment 2, the scanning signal lines Gr are also scanned less frequently than the scanning signal lines Gg.

Specifically, in the first and fifth frame periods (that is, frame periods that are neither multiples of 2 nor multiples of 3), the scanning line drive circuit 4 carries out scanning of all the scanning signal lines Gr, the scanning signal lines Gg and the scanning signal lines Gb (see FIGS. 5 and 9).

On the other hand, in the second, fourth, and sixth frame periods (that is, frame periods that are multiples of 2), the scanning signal lines Gb are not scanned. That is, there are provided non-scanning periods during which the scanning signal lines Gb are not scanned (see FIGS. 6, 8, and 10). Also in subsequent frame periods, as with the second, fourth, and sixth frame periods, there are provided non-scanning periods for the scanning signal lines Gb for every two frame periods.

Furthermore, in the third and sixth frame periods (that is, frame periods that are multiples of 3), the scanning signal lines Gr are not scanned (see FIGS. 7 and 10). That is, there are provided non-scanning periods during which the scanning signal lines Gr are not scanned. Also in subsequent frame periods, as with the third and sixth frame periods, there are provided non-scanning periods for the scanning signal lines Gr for every three frame periods.

Since the display device 1 of Embodiment 2 is configured like above, the scanning signal lines Gb are scanned half as frequently as the scanning signal lines Gg. Furthermore, the scanning signal lines Gr are scanned two-thirds as frequently as the scanning signal lines Gg. Since a refresh rate for the scanning signal lines Gg in the display device 1 of Embodiment 2 is 60 Hz, a refresh rate for the scanning signal lines Gr is 40 Hz. A refresh rate for the scanning signal lines Gb is 30 Hz.

The display device 1 of Embodiment 2 is the same as the display device 1 of Embodiment 1 in that it carries out a control such that the timing controller 10 supplies, to the scanning line drive circuit 4, a gate output control signal GOE whose level is kept at high level to thereby cause the scanning line drive circuit 4 not to carry out scanning during the non-scanning periods. Furthermore, the display device 1 of Embodiment 2 is the same as the display device 1 of Embodiment 1 also in that the signal line drive circuit 6 is stopped or performance of the signal line drive circuit 6 is reduced during the non-scanning periods.

(Power-Saving Effect)

The following description will discuss a power-saving effect brought about by the display device 1 of Embodiment 2. Similarly to Embodiment 1, the following description deals with an example in which a resolution of the display device 1 is 1366×768.

First, the following describes how much power is consumed when the display device 1 is caused to carry out a conventional display operation described with reference to FIG. 2. In this case, as described in Embodiment 1, power consumed by the signal line drive circuit 6 is approximately 88 mW, and power consumed by the scanning line drive circuit 4 is approximately 8.1 mW.

Next, the following describes power consumed by the display device 1 in a case where the display device 1 is caused to carry out a display operation in accordance with Embodiment 2 of the present invention as described with reference to FIGS. 5 through 10.

As described earlier, the display device 1 of Embodiment 2 is configured such that the scanning line drive circuit 4 and the signal line drive circuit 6 are in the non-operating state during non-scanning periods during which the scanning signal lines Gb are not scanned. The non-scanning periods account for one third of all the horizontal scanning periods included in one half of all the frame periods.

This reduces the power consumed by the signal line drive circuit 6 by 88 mW×⅓×½=approximately 14.7 mW. That is, power consumed by the signal line drive circuit 6 is 88 mW−14.7 mW=73.3 mW.

Similarly, power consumed by the scanning line drive circuit 4 is reduced by 8.1 mW×⅓×½=approximately 1.4 mW. That is, power consumed by the scanning line drive circuit 4 is 8.1 mW−1.4 mW=6.7 mW.

In addition, the display device 1 of Embodiment 2 configured such that the scanning line drive circuit 4 and the signal line drive circuit 6 are in the non-operating state also during non-scanning periods during which the scanning signal lines Gr are not scanned. The non-scanning periods account for one third of all the horizontal scanning periods included in one third of all the frame periods.

This further reduces power consumed by the signal line drive circuit 6 by 88 mW×⅓×⅓=approximately 9.8 mW. That is, power consumed by the signal line drive circuit 6 is 73.3 mW−9.8 mW=63.5 mW. In this way, the display device 1 of the present embodiment achieves power saving of approximately 28% in the signal line drive circuit 6.

Similarly, power consumed by the scanning line drive circuit 4 is further reduced by 8.1 mW×⅓×⅓=0.9 mW. That is, power consumed by the scanning line drive circuit 4 is 6.7 mW−0.9 mW=5.8 mW. In this way, the display device 1 of the present embodiment achieves power saving of approximately 28% in the scanning line drive circuit 4.

(Operation and Effect)

As has been described, the display device 1 of Embodiment 2 is configured such that (i) among a plurality of scanning signal lines G, scanning signal lines for displaying a first certain color are scanned less frequently than scanning signal lines for displaying the other colors and (ii) among the scanning signal lines for displaying the other colors, scanning signal lines for displaying a second certain color are scanned less frequently than scanning signal lines for displaying the rest of the other colors. The display device 1 of the present embodiment is therefore able to further reduce power consumption as described above, as compared to a display device that does not employ the above configuration.

Note that the display device 1 of Embodiment 2 is configured such that scanning signal lines for a plurality of colors are scanned less frequently. Therefore, the display device 1 of Embodiment 2 is inferior to some degree to the display device 1 of Embodiment 1 in terms of suppression of flicker (flickering) on a screen. However, as compared to a conventional display device which is configured such that all the scanning signal lines are scanned less frequently, the display device 1 of Embodiment 2 causes less flicker (flickering) on a screen and also makes it possible to display moving images more smoothly. That is, according to the display device 1 of Embodiment 2, it is possible to reduce power consumption while maintaining a high quality of moving images.

In particular, the display device 1 of Embodiment 2 is configured such that the scanning signal lines Gb for displaying blue and the scanning signal lines Gr for displaying red (blue (B) and red (R) have lower luminance ratio than green (G)) are scanned less frequently. According to the display device 1 of the present embodiment configured like above, less luminance change occurs and thus flicker (flickering) on a screen is less likely to occur, as compared to a display device configured such that scanning signal lines other than the scanning signal lines Gb and the scanning signal lines Gr are scanned less frequently. Furthermore, awkward movement of a moving image, which results from a reduction in the number of times scanning is carried out, is less perceivable by a viewer. That is, according to the display device 1 of the present embodiment, it is possible to reduce power consumption while maintaining a high quality of moving images.

Furthermore, the display device 1 of the present embodiment is configured such that performance of the signal line drive circuit 6 is reduced during both (i) horizontal scanning periods during which the scanning signal lines Gb are not scanned and (ii) horizontal scanning periods during which the scanning signal lines Gr are not scanned. According to the display device 1 of the present embodiment configured like above, it is possible to achieve greater power saving than a display device without such a configuration. Note that, since the above horizontal scanning periods are periods during which the screen is not rewritten, there is no impact on a quality of moving images even in a case where the configuration is employed.

Furthermore, according to the display device 1 of Embodiment 2, the scanning signal lines Gb are caused to be scanned less frequently than the scanning signal lines Gg and the scanning signal lines Gr by providing frame periods during which the scanning signal lines Gb are not scanned. That is, the number of times the scanning signal lines Gb are scanned is reduced by not scanning the scanning signal lines Gb during the above frame periods.

Furthermore, there are provided frame periods during which the scanning signal lines Gr are not scanned, whereby the scanning signal lines Gr are scanned less frequently than the scanning signal lines Gg. That is, the number of times the scanning signal lines Gr are scanned is reduced by not scanning the scanning signal lines Gr during the above frame periods.

As such, it possible to cause the scanning signal lines Gb and the scanning signal lines Gr to be scanned less frequently, merely by employing a simple configuration in which waveforms of control signals (in the present embodiment, gate output control signals GOE) for scanning the scanning signal lines Gb and waveforms of control signals for scanning the scanning signal lines Gr are different from those of control signals for scanning the scanning signal lines Gg. For example, it is possible to realize the configuration, in which the scanning signal lines Gb and the scanning signal lines Gr are scanned less frequently, at a lower cost than other configurations such as a configuration in which frame periods for the scanning signal lines Gb and the scanning signal lines Gr are different in length from those for the scanning signal lines Gg.

Figure 11:
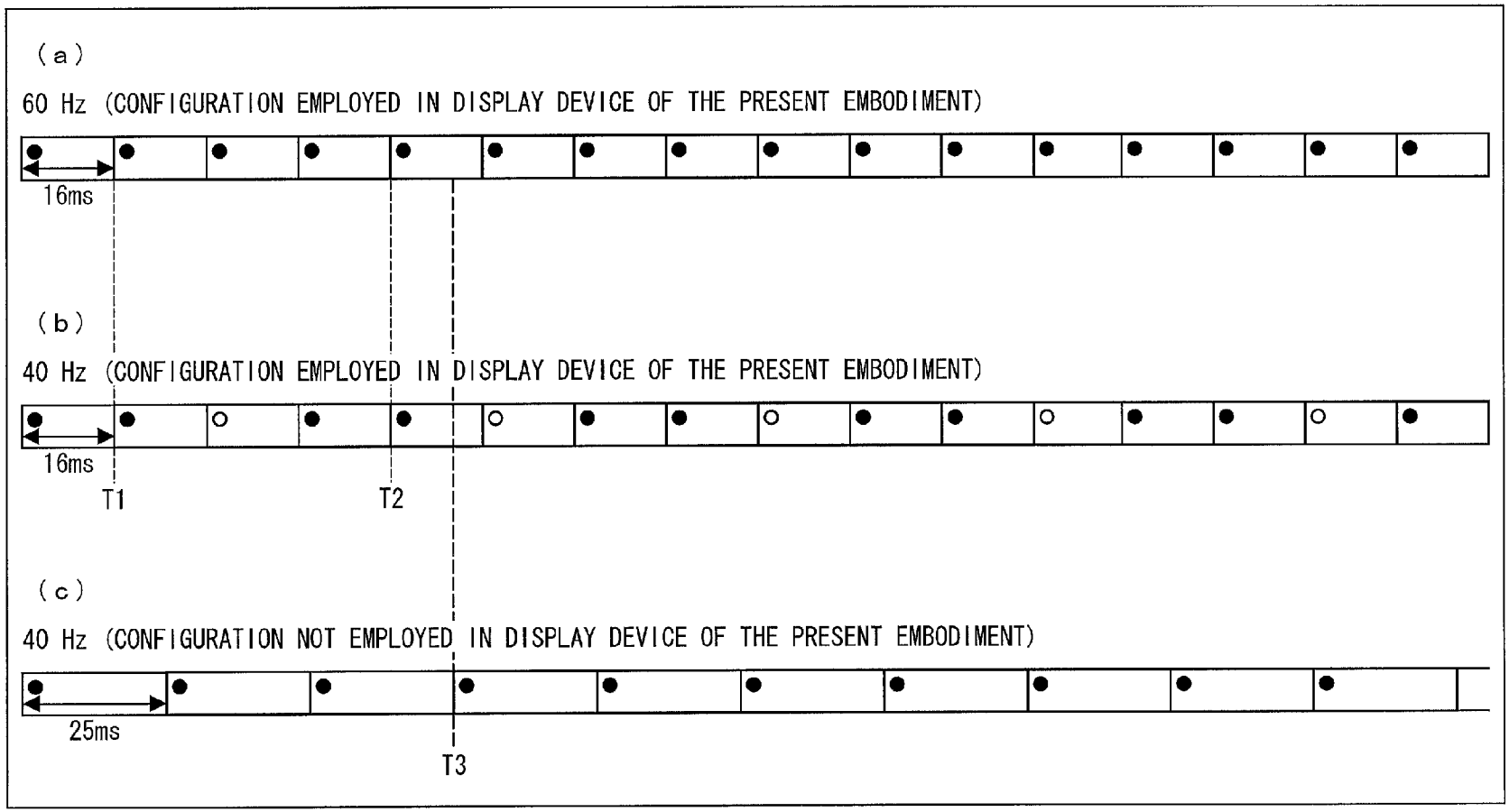
FIG. 11 is a view illustrating structures of frame periods employed when a display device carries out a display operation.

This is specifically described with reference to FIG. 11. FIG. 11 is a view illustrating structures of frame periods employed when a display device carries out a display operation. Note that, in FIG. 11, frame periods marked with filled circles are frame periods in which scanning of scanning signal lines is carried out. On the other hand, frame periods marked with hollow circles are frame periods in which scanning of scanning signal lines is not carried out.

(a) of FIG. 11 is a view illustrating a structure of frame periods for the scanning signal lines Gg, which is employed in the display device 1 of Embodiment 2. As shown in (a) of FIG. 11, a refresh rate for the scanning signal lines Gg in the display device 1 of Embodiment 2 is 60 Hz. Therefore, one (1) frame period for the scanning signal lines Gg is 16 ms.

(b) of FIG. 11 is a view illustrating a structure of frame periods for the scanning signal lines Gr, which is employed in the display device 1 of Embodiment 2. As shown in (b) of FIG. 11, a refresh rate for the scanning signal lines Gr in the display device 1 of Embodiment 2 is 40 Hz. However, one (1) frame period for the scanning signal lines Gr in (b) of FIG. 11 is 16 ms, which is the same as that for the scanning signal lines Gg. This is because the refresh rate for the scanning signal lines Gg in (b) of FIG. 11 is caused to be 40 Hz by not scanning the scanning signal lines Gr during frame periods that account for one third of the frames for the scanning signal lines Gg.

On the other hand, (c) of FIG. 11 is a view illustrating a structure of frame periods for the scanning signal lines Gr, which is not employed in the display device 1 of Embodiment 2. In an example as shown in (c) of FIG. 11, a refresh rate for the scanning signal lines Gr is 40 Hz, which is the same as (b) of FIG. 11. However, one frame period for the scanning signal lines Gr in (c) of FIG. 11 is 25 ms, which is different from that for the scanning signal lines Gg. This is because the refresh rate for the scanning signal lines Gg in (c) of FIG. 11 is caused to be 40 Hz by changing the length of a frame period for the scanning signal lines Gr so that it is different from that for the scanning signal lines Gg, instead of providing frame periods during which the scanning signal lines Gr are not scanned.

In a case where a refresh rate for the scanning signal lines Gb is set by changing the length of one frame period for the scanning signal lines Gb so that the one frame period for the scanning signal lines Gb is different from that for the scanning signal lines Gg serving as a reference (like the example shown in (c) of FIG. 11), the scanning signal lines Gg and the scanning signal lines Gb are different from each other in terms of various timings such as a timing at which each frame period starts, a timing at which each frame period ends, and a timing at which data is written (see timing T3 in FIG. 11). This necessitates a circuit having a very complicated configuration to control these scanning signal lines.

On the other hand, in a case where the refresh rate for the scanning signal lines Gb is set without changing the length of one frame period for the scanning signal lines Gb so that the one frame period for the scanning signal lines Gb is the same as that for the scanning signal lines Gg which serves as a reference as in the example shown in (b) of FIG. 11 which is employed in the display device 1 of Embodiment 2, the scanning signal lines Gg and the scanning signal lines Gb are always the same in terms of various timings such as a timing at which each frame period starts, a timing at which each frame period ends, and a timing at which data is written (see timings T1 and T2 in FIG. 11). Accordingly, it is only necessary to provide a circuit having a simple configuration to control these scanning signal lines.

It should be noted that, if a cost and the like are not given much importance, the refresh rate for the scanning signal lines Gb may be set by changing the length of one frame period for the scanning signal lines Gb so that the frame period for the scanning signal lines Gb is different from that for the scanning signal lines Gg which serves as a reference (like the example shown in (c) of FIG. 11). Even in this case, it is still possible to reduce power consumption.

Embodiment 3

Next, Embodiment 3 of the present invention will be described. As described in Embodiment 1, the display device 1 in Embodiment 1 reverses a polarity of a voltage applied to each of the data signal lines S for every frame period. In this case, if non-scanning periods for certain scanning signal lines G are provided for every two frame periods, a polarity of a voltage applied to each of pixel electrodes corresponding to the certain scanning signal lines G is always constant.

Specifically, the display device 1 of Embodiment 1 is configured such that, in each of the odd-numbered frame periods, there are provided non-scanning periods during which the scanning signal lines Gb are not scanned. In other words, non-scanning periods for the scanning signal lines Gb are provided in every two frame periods.

The following description focuses on a third scanning signal line G(3). As illustrated in FIG. 3, a voltage having a positive polarity is applied to each of pixel electrodes corresponding to the scanning signal line G(3) during an even-numbered frame period. On the other hand, since the scanning signal line G(3) is not scanned during an odd-frame period as illustrated in FIG. 4, no voltage is applied to each of the pixel electrodes corresponding to the scanning signal line G(3).

Also in subsequent frame periods, an even-numbered frame period and an odd-numbered frame period are alternately repeated. Therefore, each of the pixel electrodes corresponding to the scanning signal line G(3) is alternately in a state in which a voltage having a positive polarity is applied and a state in which no voltage is applied. That is, the voltage applied to each of the pixel electrodes corresponding to the scanning signal line G(3) always has a positive polarity.

This is because the non-scanning periods during which the scanning signal lines Gb are not scanned come every two frame periods. Since there are no non-scanning periods for the scanning signal lines Gr and the scanning signal lines Gg, the scanning signal lines Gr and the scanning signal lines Gg do not suffer such a problem.

If the voltage applied to each of the pixel electrodes corresponding to a scanning signal line G is always constant like above, a problem such as image sticking may occur.

In view of the circumstances, a display device 1 of Embodiment 3 is configured such that scanning signal lines G which are not scanned during non-scanning periods that come every two frame periods, are driven while their polarities are reversed for every certain number of frame periods excluding frame periods in which the non-scanning periods are provided. Specifically, the display device 1 of Embodiment 3 is configured such that the scanning signal lines Gb, which are not scanned during non-scanning periods that come every two frame periods, are driven while their polarities are reversed for every frame period, except odd-numbered frame periods in which the non-scanning periods are provided.

The following description will discuss, with reference to FIGS. 12 through 15, a display operation carried out by the display device 1 of Embodiment 3. Note that, since a configuration of the display device 1 of Embodiment 3 is the same as that of the display device 1 of Embodiment 1, its description is omitted here. However, a display operation carried out by the display device 1 of Embodiment 3 is different in some points from that carried out by the display device 1 of Embodiment 1. Therefore, the following description discusses only such differences between the display operation carried out by the display device 1 of Embodiment 3 and that carried out by the display device 1 of Embodiment 1.

(Display Operation by Display Device 1)

Figure 12:
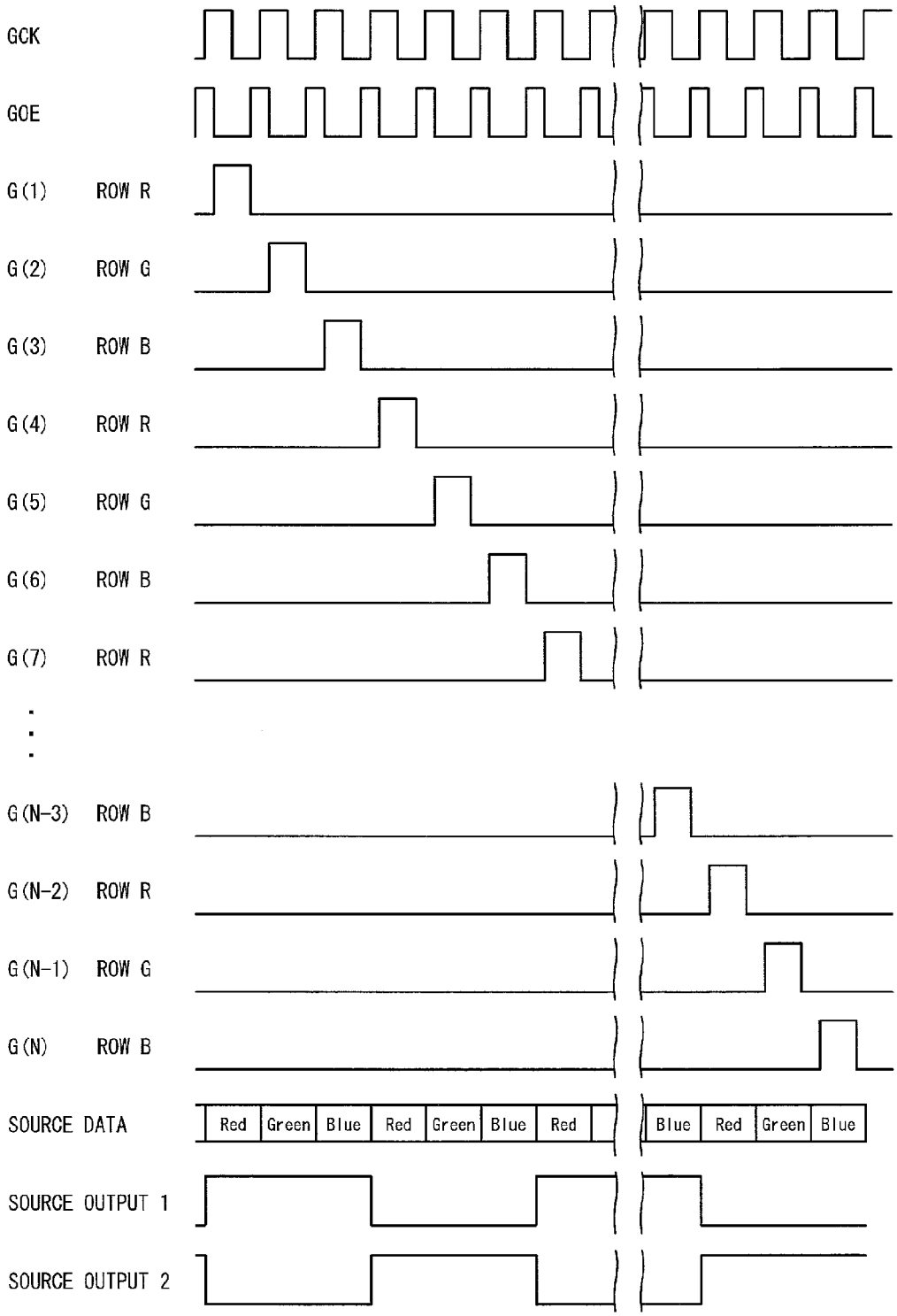
FIG. 12 is a view illustrating signal waveforms for a display operation carried out by a display device 1 in accordance with Embodiment 3.
Figure 13:
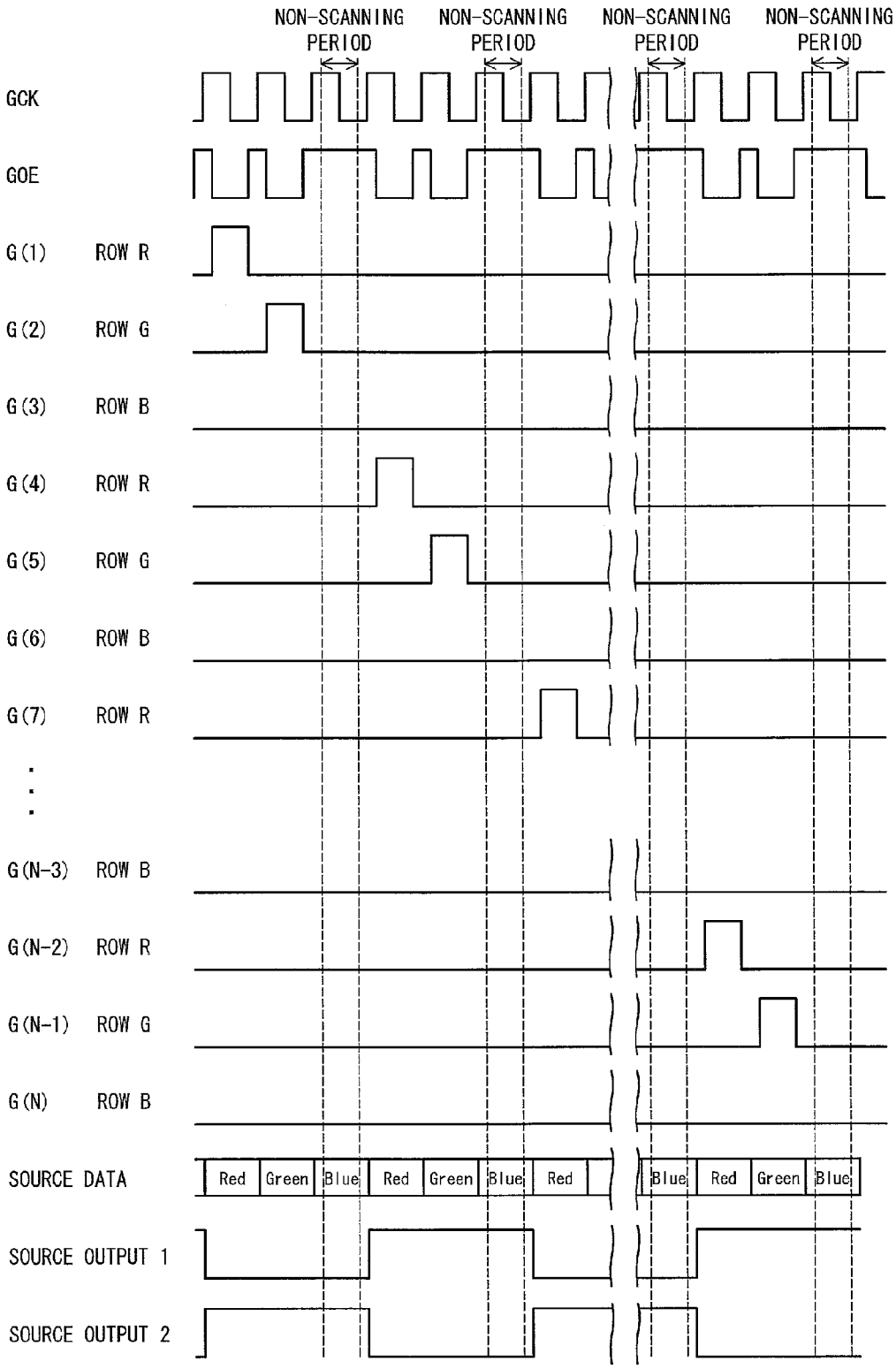
FIG. 13 is a view illustrating signal waveforms for the display operation carried out by the display device 1 in accordance with Embodiment 3.
Figure 14:
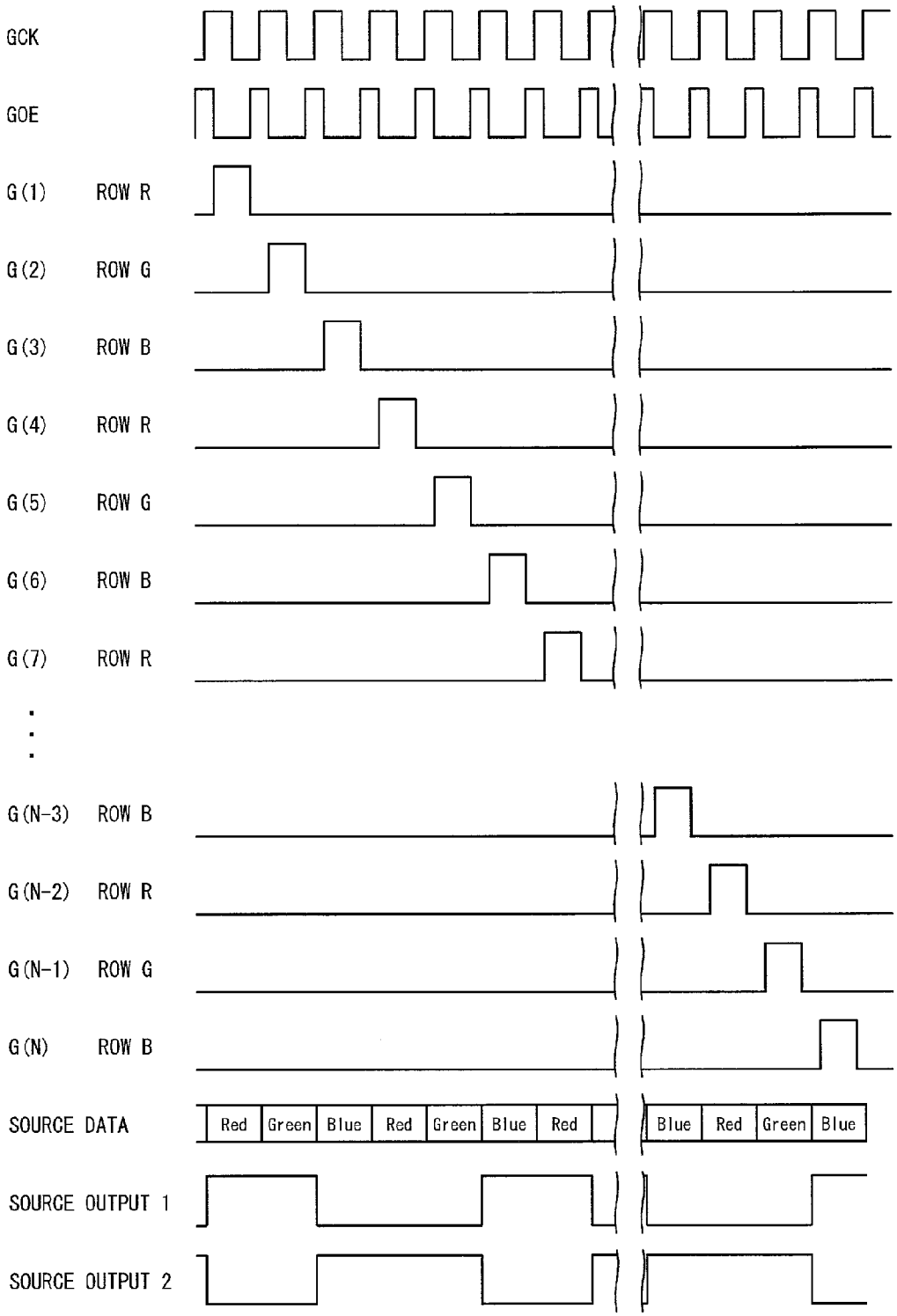
FIG. 14 is a view illustrating signal waveforms for the display operation carried out by the display device 1 in accordance with Embodiment 3.
Figure 15:
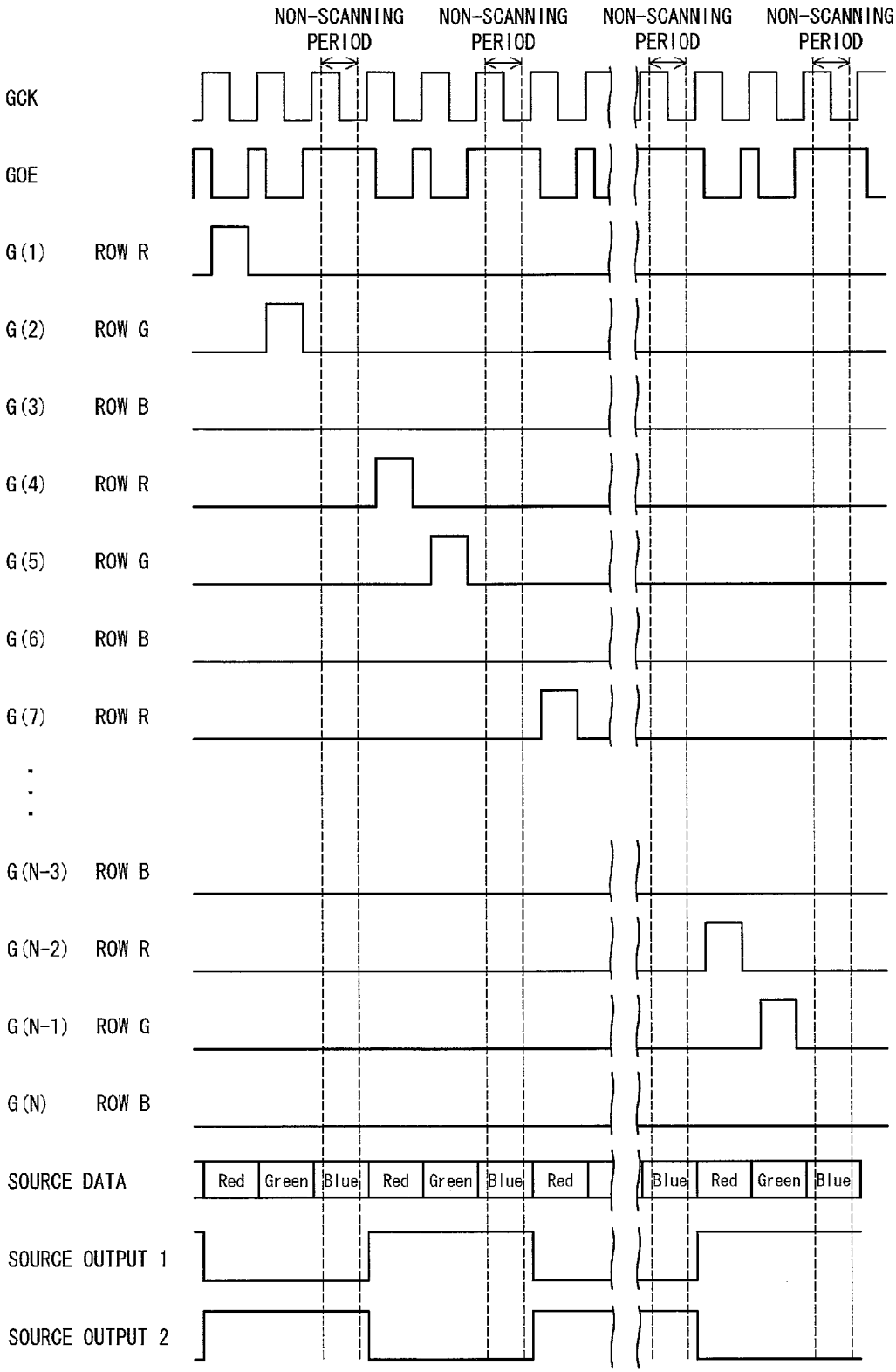
FIG. 15 is a view illustrating signal waveforms for the display operation carried out by the display device 1 in accordance with Embodiment 3.

FIGS. 12 through 15 are views illustrating signal waveforms for a display operation carried out by the display device 1 in accordance with Embodiment 3. FIG. 12 is a view illustrating signal waveforms in a first frame period. FIG. 13 is a view illustrating signal waveforms in a second frame period. FIG. 14 is a view illustrating signal waveforms in a third frame period. FIG. 15 is a view illustrating signal waveforms in a fourth frame period.

The display device 1 of Embodiment 3 operates in the same manner as the display device 1 of Embodiment 1 in that the scanning signal lines Gb are scanned half as frequently as the scanning signal lines Gr and the scanning signal lines Gg. Specifically, in even-numbered frame periods, the scanning line drive circuit 4 carries out scanning of all the scanning signal lines Gr, the scanning signal lines Gg, and the scanning signal lines Gb (see FIGS. 12 and 14). On the other hand, in odd-numbered frame periods, the scanning line drive circuit 4 (i) carries out scanning of the scanning signal lines Gr and the scanning signal lines Gg in the same manner as in the even-numbered frame periods but (i) does not carry out scanning of the scanning signal lines Gb (see FIGS. 13 and 15). That is, there are provided non-scanning periods during which the scanning signal lines Gb are not scanned.

Note here that the display device 1 of Embodiment 3 is configured such that, as described above, a polarity of a voltage applied to each of pixel electrodes corresponding to the scanning signal line G3, which is one of the scanning signal lines Gb which are not scanned during non-scanning periods that come every two frame periods, is reversed for every frame period provided that odd-numbered frame periods in which the non-scanning periods are provided do not count (that is, reversed for every two even-numbered frame periods).

For example, the following description focuses on the third scanning signal line G(3) in FIGS. 12 through 15. During the first even-numbered frame period, a voltage having a positive polarity is applied to each of pixel electrodes corresponding to the scanning signal line G(3) (see FIG. 12). On the other hand, during the second even-numbered frame period, a voltage having a negative polarity is applied to each of the pixel electrodes corresponding to the scanning signal line G(3) (see FIG. 14).

Also in subsequent frame periods, the first even-numbered frame period and the second even-numbered frame period are alternately repeated, provided that odd-numbered frame periods do not count. Therefore, each of the pixel electrodes corresponding to the scanning signal line G3 is alternately in a state in which a voltage having a positive polarity is applied and in a state in which a voltage having a negative polarity is applied. That is, a voltage applied to each of the pixel electrodes corresponding to the scanning signal line G(3) is not constant.

The following description focuses on a sixth scanning signal line G(6) in FIGS. 12 through 15. During the first even-numbered frame period, a voltage having a negative polarity is applied to each of pixel electrodes corresponding to the scanning signal line G(6) (see FIG. 12). On the other hand, during the second even-numbered frame period, a voltage having a positive polarity is applied to each of the pixel electrodes corresponding to the scanning signal lines G(6) (see FIG. 14).

Also in subsequent frame periods, the first even-numbered frame period and the second even-numbered frame period are alternately repeated, provided that odd-numbered frame periods do not count. Therefore, each of the pixel electrodes corresponding to the scanning signal line G(6) is alternately in a state in which a voltage having a negative polarity is applied and in a state in which a voltage having a positive polarity is applied. That is, a voltage applied to each of the pixel electrodes corresponding to the scanning signal line G(6) is not constant.

Note that, the display device 1 of Embodiment 3 is the same as the display device of Embodiment 1 in that it carries out a control such that the timing controller 10 supplies, to the scanning line drive circuit 4, a gate output control signal GOE whose level is kept at a high level to thereby cause the scanning line drive circuit 4 not to carry out scanning. Furthermore, the display device 1 of Embodiment 3 is the same as the display device 1 of Embodiment 1 also in that the signal line drive circuit 6 is stopped or performance of the signal line drive circuit 6 is reduced during the non-scanning periods.

(Operation and Effect)

As has been described, the display device 1 of Embodiment 3 is configured such that the scanning signal lines Gr, which are not scanned during non-scanning periods that come every frame periods, is reversed in their polarities for every frame period, provided that frame periods in which the non-scanning periods are provided do not count. According to the display device 1 of Embodiment 3 configured like above, a voltage applied to each of pixel electrodes corresponding to a scanning signal line Gr is not constant, and thus it is possible to prevent occurrence of problems such as image sticking.

Note that the display device 1 of Embodiment 3 is the same as the display device 1 of Embodiment 1, except for the above point. Therefore, the display device 1 of Embodiment 3 brings about the same effect as that brought about by the display device 1 of Embodiment 1.

Embodiment 4

Next, Embodiment 4 of the present invention will be described. In Embodiments 1 through 3, scanning signal lines G for a certain color(s) in the entire screen are scanned less frequently. However, this does not imply any limitation, and therefore it is also possible to employ a configuration in which scanning signal lines G for a certain color(s) in part of the screen are scanned less frequently.

According to a display device 1 of Embodiment 4, a display panel 2 is divided into two regions: an upper region and a lower region. The upper region is a moving image display region, and the lower region is a still image display region. In the still image display region, scanning signal lines G for a certain color(s) are scanned less frequently for greater power saving. On the other hand, in the moving image display region, scanning signal lines G for the certain color(s) are scanned as frequently as the other scanning signal lines for the purpose of achieving a higher image quality.

(Display Operation by Display Device 1)

Figure 16:
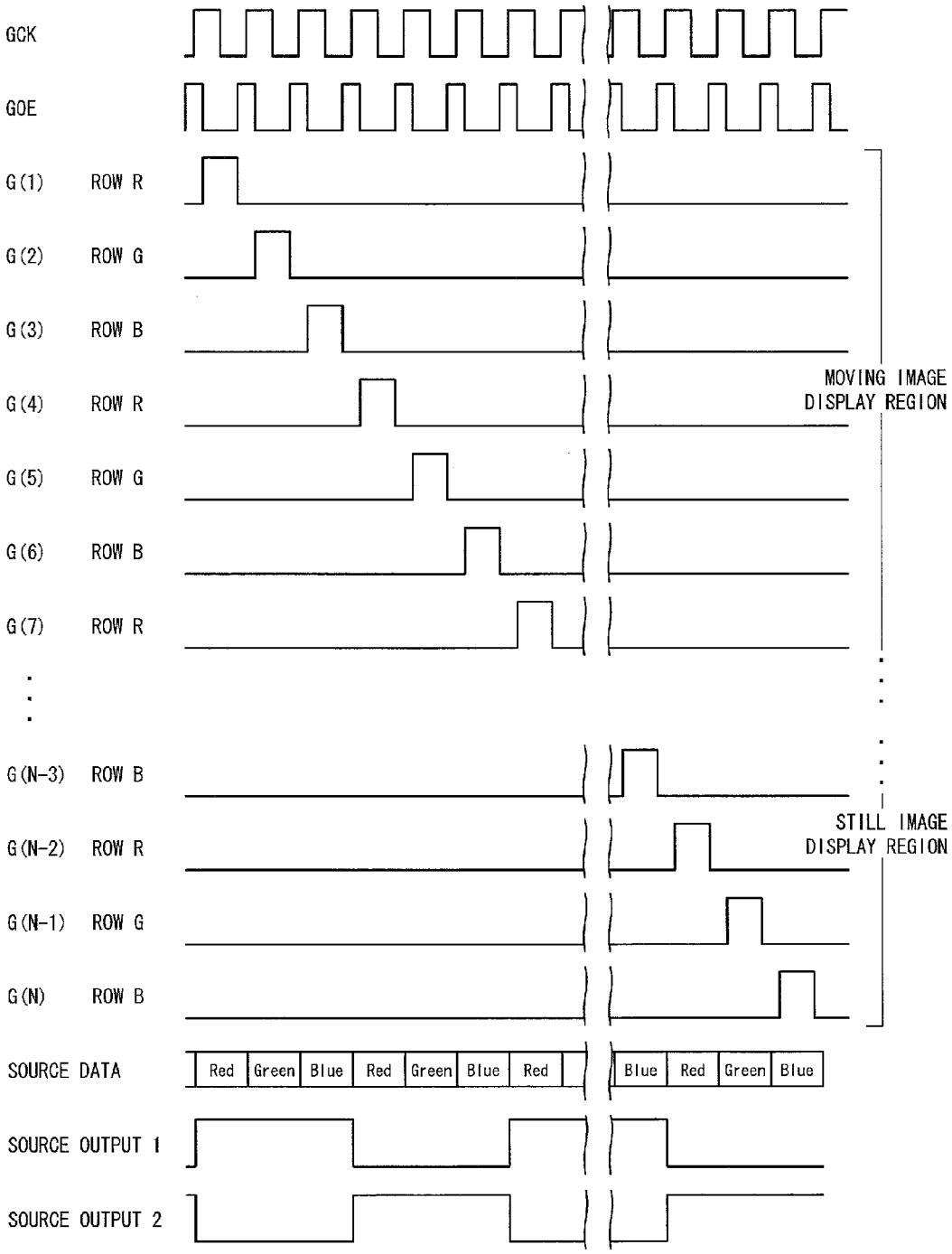
FIG. 16 is a view illustrating signal waveforms for a display operation carried out by a display device 1 in accordance with Embodiment 4.
Figure 17:
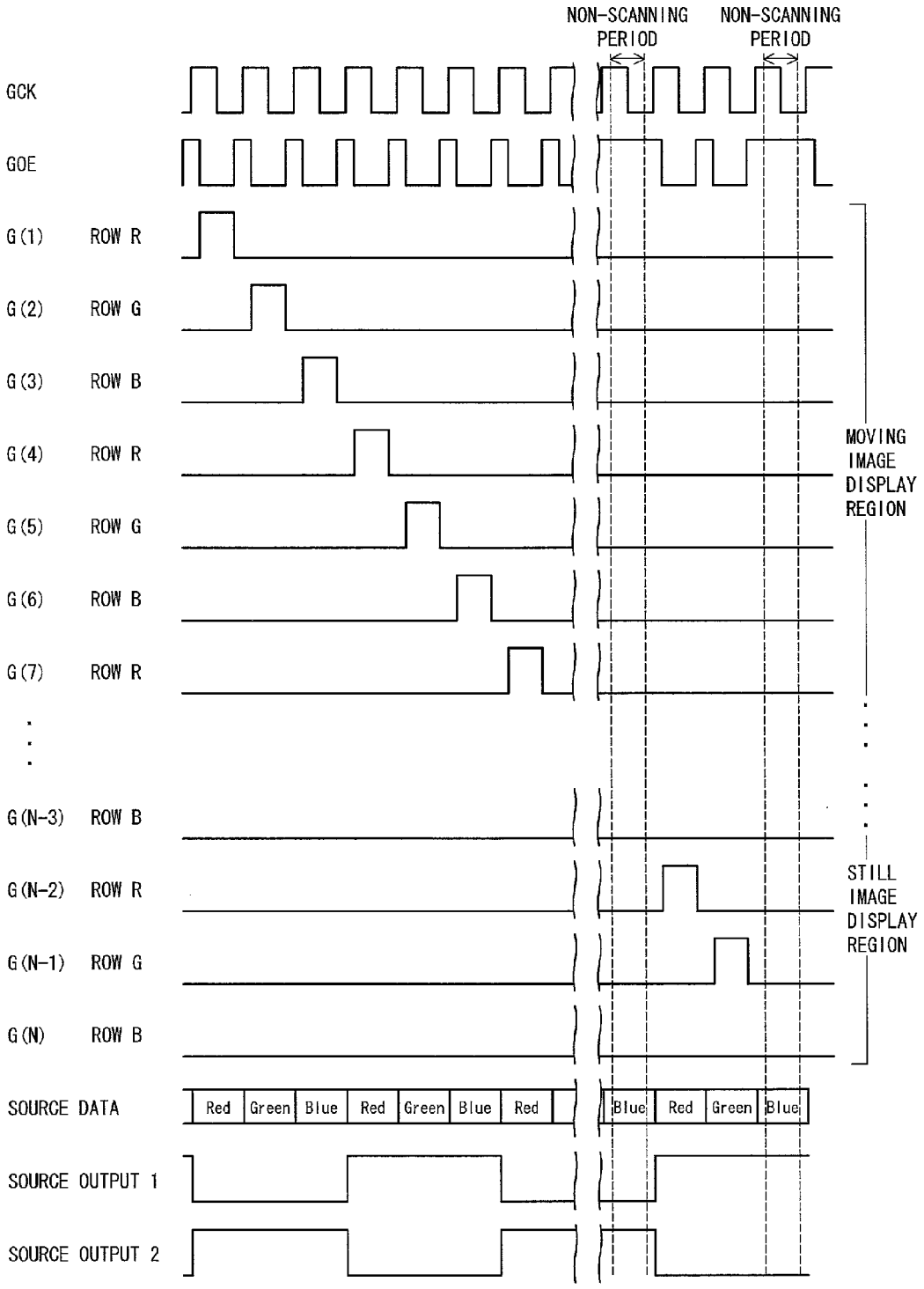
FIG. 17 is a view illustrating signal waveforms for the display operation carried out by the display device 1 in accordance with Embodiment 4.

FIGS. 16 and 17 are views illustrating signal waveforms for a display operation carried out by the display device 1 in accordance with Embodiment 4. FIG. 16 is a view illustrating signal waveforms in an even-numbered frame period. FIG. 17 is a view illustrating signal waveforms in an odd-numbered frame period.

The display device of Embodiment 4 operates in the same manner as the display device 1 of Embodiment 1 as to the still image display region, in that the scanning signal lines Gb are scanned half as frequently as the scanning signal lines Gr and the scanning signal lines Gg. Specifically, as shown in FIG. 16, during an even-numbered frame period, a scanning line drive circuit 4 carries out scanning of all the scanning signal lines Gr, the scanning signal lines Gg, and the scanning signal lines Gb. On the other hand, as shown in FIG. 17, during an odd-numbered frame period, the scanning line drive circuit 4 (i) carries out scanning of the scanning signal lines Gr and the scanning signal lines Gg in the same manner as in the even-numbered frame period but (ii) does not carry out scanning of the scanning signal lines Gb. That is, there are provided non-scanning periods during which the scanning signal lines Gb are not scanned.

On the other hand, the display device 1 of Embodiment 4 operates in a manner different from the display device 1 of Embodiment 1 in that, in the moving image display region, scanning signal lines Gb are scanned as frequently as the other scanning signal lines. Specifically, as shown in FIG. 16, during an even-numbered frame period, the scanning line drive circuit 4 carries out scanning of all the scanning signal lines Gr, the scanning signal lines Gg, and the scanning signal lines Gb. Furthermore, as shown in FIG. 17, also in an odd-numbered frame period, the scanning line drive circuit 4 carries out scanning of all the scanning signal lines Gr, the scanning signal lines Gg, and the scanning signal lines Gb.

Note that the display device 1 of Embodiment 4 is the same as the display device 1 of Embodiment 1 in that it carries out a control such that the timing controller 10 supplies, to the scanning line drive circuit 4, a gate output control signal GOE whose level is kept at high level to thereby cause the scanning line drive circuit 4 not to carry out scanning during the non-scanning periods. Furthermore, the display device 1 of Embodiment 4 is the same as the display device 1 of Embodiment 1 also in that the signal line drive circuit 6 is stopped or performance of the signal line drive circuit 6 is reduced during the non-scanning periods.

(Power-Saving Effect)

The following description will discuss a power-saving effect brought about by the display device 1 of Embodiment 4. Similarly to Embodiment 1, the following description deals with an example in which a resolution of the display device 1 is 1366×768.

First, the following describes how much power is consumed when the display device 1 is caused to carry out a conventional display operation described with reference to FIG. 2. In this case, as described in Embodiment 1, power consumed by the signal line drive circuit 6 is approximately 88 mW, and power consumed by the scanning line drive circuit 4 is approximately 8.1 mW.

Next, the following describes power consumed by the display device 1 in a case where the display device 1 is caused to carry out a display operation in accordance with Embodiment 4 of the present invention as described with reference to FIGS. 16 and 17.

As described earlier, the display device 1 of Embodiment 4 is configured such that, in the still image display region which accounts for one half of the screen, the scanning line drive circuit 4 and the signal line drive circuit 6 are in a non-operating state during non-scanning periods during which the scanning signal lines Gb are not scanned. The non-scanning periods account for one third of all the horizontal scanning periods included in one half of all the frame periods.

This reduces power consumed by the signal line drive circuit 6 by 88 mW×½×⅓×½=approximately 7.3 mW. That is, power consumed by the signal line drive circuit 6 is 88 mW−7.3 mW=80.7 mW. In this way, the display device 1 of the present embodiment achieves power saving of approximately 8.3% in the signal line drive circuit 6.

Similarly, power consumed by the scanning line drive circuit 4 is reduced by 8.1 mW×½×⅓×½=0.7 mW. That is, power consumed by the scanning line drive circuit 4 is 8.1 mW−0.7 mW=7.4 mW. In this way, the display device 1 of the present embodiment achieves power saving of approximately 8.3% in the scanning line drive circuit 4.

As has been described, according to the display device 1 of Embodiment 4, (i) the scanning signal lines Gb in the still image display region are scanned less frequently but (ii) the scanning signal lines Gb in the moving image display region are scanned as frequently as the other scanning signal lines. This makes it possible to (i) reduce power consumption while maintaining a high quality of images in the still image display region and (ii) achieve a higher quality of moving images in the moving images display region.

In a case where a certain display region is desired to have a higher image quality like Embodiment 4, the display device can be configured such that certain scanning signal lines in that display region are scanned less frequently. Note here that a region where the certain scanning signal lines are caused to be scanned less frequently is not limited to a moving image display region.

Furthermore, a region in which the certain scanning signal lines are caused to be scanned less frequently is not limited to an upper portion of the screen.

Embodiment 5

Next, Embodiment 5 of the present invention will be described. Embodiments 1 through 4 dealt with the display panel 2 which employs a horizontal striped pattern (that is, a display panel in which one row of pixels corresponds to one color). However, this does not imply any limitation. For example, the display panel 2 can be arranged such that a row of pixels corresponds to a plurality of colors. In view of the circumstances, Embodiment 5 deals with an example in which the display panel 2 is arranged such that a row of pixels corresponds to a plurality of colors.

(Arrangement of Colors of Pixels in Display Panel 2)

FIG. 18 is a view illustrating how colors to be displayed in pixels are arranged in the display panel 2 of the display device 1. (a) of FIG. 18 is a view illustrating how colors to be displayed in pixels are arranged in the display panel 2 of the display device 1 of each of Embodiments 1 through 4. (b) of FIG. 18 is a view illustrating how colors to be displayed in pixels are arranged in the display panel 2 of the display device 1 of Embodiment 5.

As shown in (a) of FIG. 18, in the display panel 2 of the display device 1 of Embodiments 1 through 4, each row of pixels is a row of pixels, for displaying one certain color, which are arranged in a line. Specifically, a first row of pixels G(1) is a row of pixels, for displaying red (R), which are arranged in a line (such a row is hereinafter referred to as a "pixel row Gr"). The pixels in the pixel row Gr are connected with a corresponding scanning signal line Gr. A second row of pixels G(2) is a row of pixels, for displaying green (G), which are arranged in a line (such a row is hereinafter referred to as a "pixel row Gg"). The pixels in the pixel row Gg are connected with a corresponding scanning signal line Gg. A third row of pixels G(3) is a row of pixels, for displaying blue (B), which are arranged in a line (such a row is hereinafter referred to as a "pixel row Gb"). The pixels in the pixel row Gb are connected with a corresponding scanning signal line Gb. Also in the rest of the display panel 2, a plurality of rows of pixels are provided such that pixel rows Gr, pixel rows Gg and pixel rows Gb are arranged in repeating patterns of three rows with a pixel row Gr first, a pixel row Gg second and a pixel row Gb third.

On the other hand, as shown in (b) of FIG. 18, in the display panel 2 of the display device 1 of Embodiment 5, each row of pixels is a row of pixels, for displaying two certain colors, which are arranged in a line. Specifically, a first row of pixels G(1) is a row in which pixels for displaying red (R) and pixels for displaying blue (B) are arranged alternately in a line (such a row is hereinafter referred to as a "pixel row Grb"). The pixels in the pixel row Grb are connected with a corresponding scanning signal line Grb. A second row of pixels G(2) is a row in which pixels for displaying green (G) and pixels for displaying white (W) are arranged alternately in a line (such a row is hereinafter referred to as a "pixel row Gwg"). The pixels in the pixel row Gwg are connected with a corresponding scanning signal line Gwg. Also in the rest of the display panel 2, a plurality of rows of pixels are arranged such that pixel rows Grb, and pixel rows Gwg are arranged alternately in repeating patterns of two rows with a pixel row Grb first and a pixel row Gwg second.

(Display Operation by Display Device 1)

Figure 19:
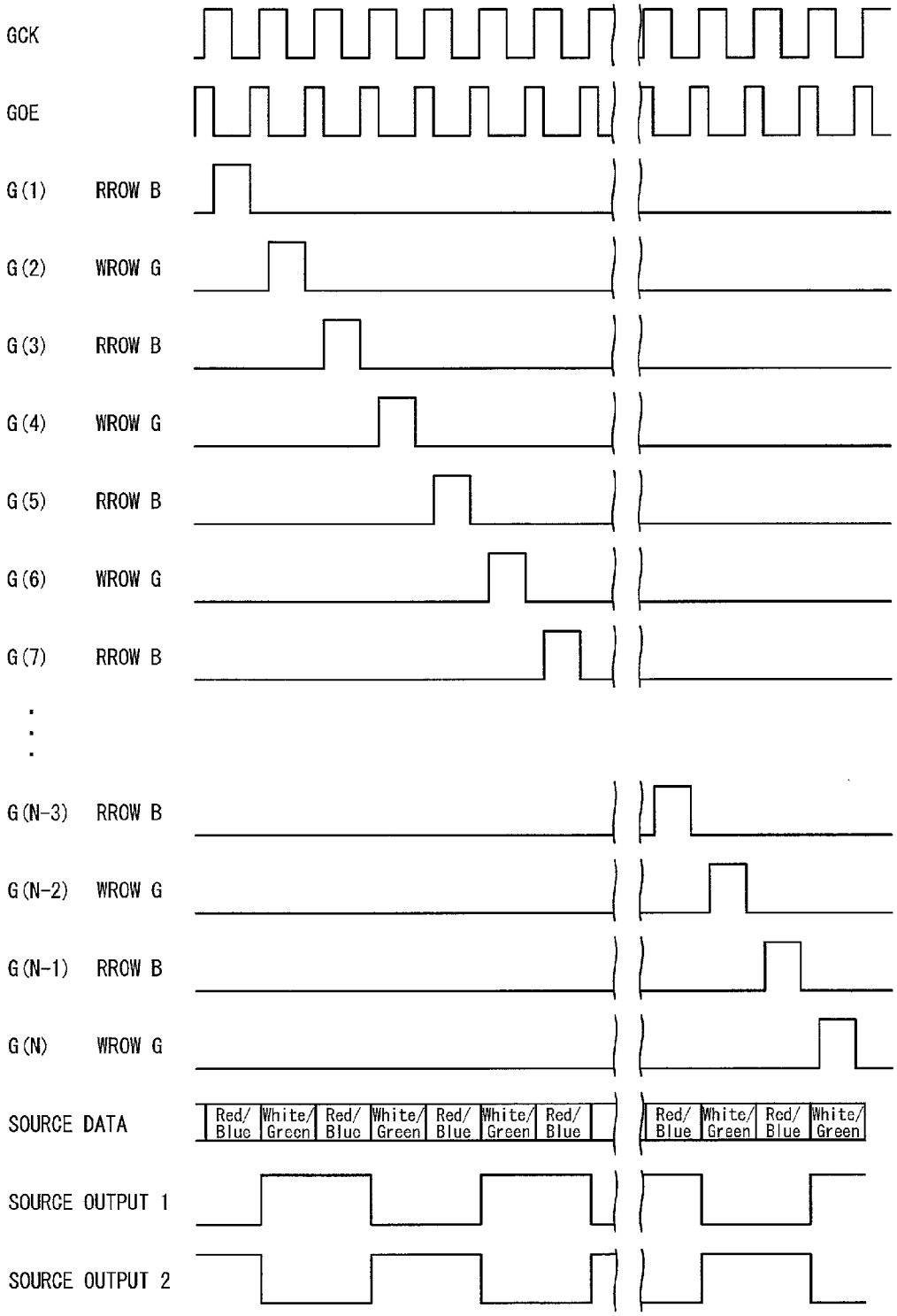
FIG. 19 is a view illustrating signal waveforms for a display operation carried out by a display device 1 in accordance with Embodiment 5.
Figure 20:
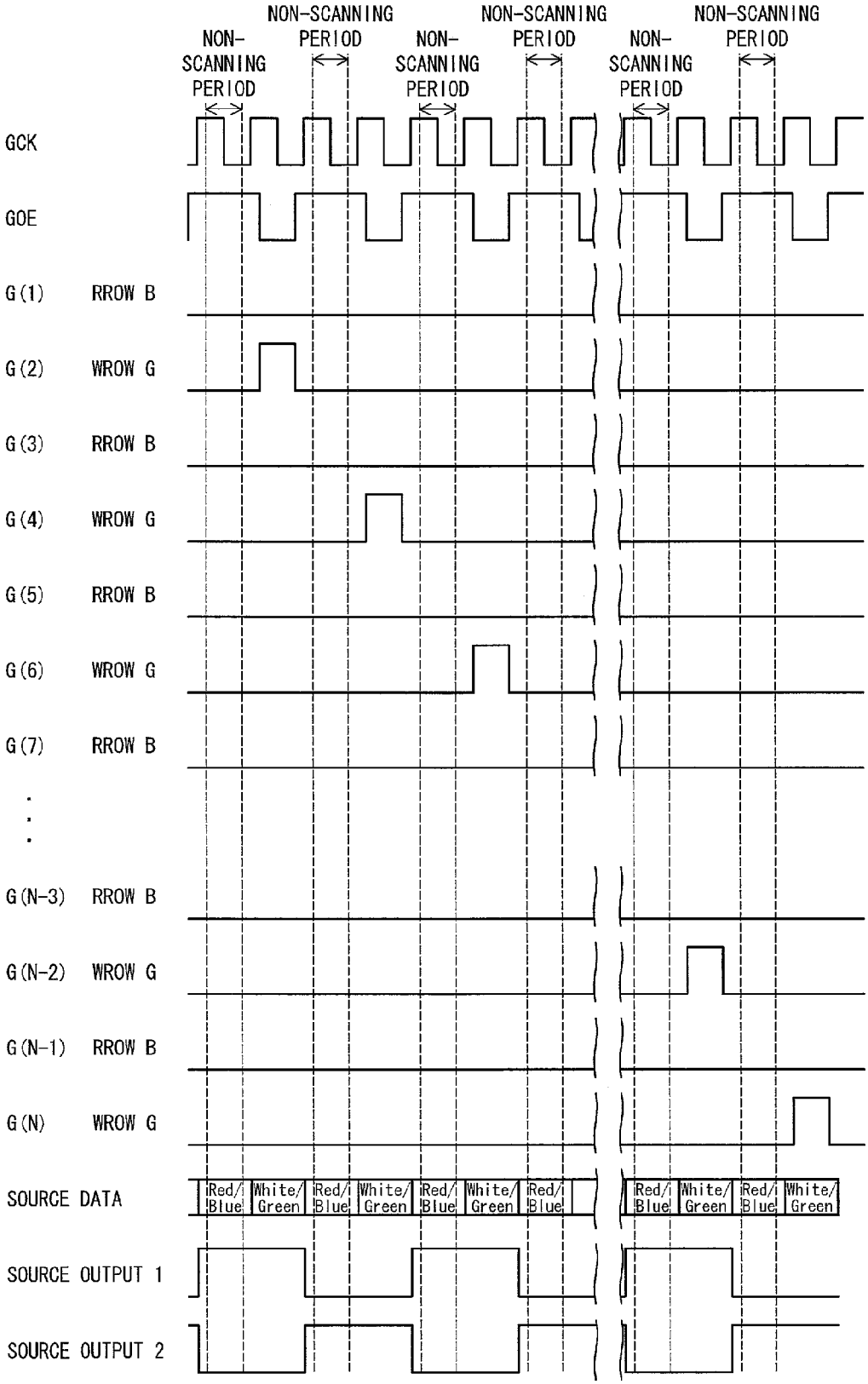
FIG. 20 is a view illustrating signal waveforms for the display operation carried out by the display device 1 in accordance with Embodiment 5.

The following description will discuss a display operation carried out by the display device 1 in accordance with Embodiment 5. FIGS. 19 and 20 are views illustrating signal waveforms for a display operation carried out by the display device 1 in accordance with Embodiment 5. FIG. 19 is a view illustrating signal waveforms in an even-numbered frame period. FIG. 20 is, on the other hand, a view illustrating signal waveforms in an odd-numbered frame period.

The display device 1 of Embodiment 5 is the same as the display device 1 of Embodiment 1 in that scanning signal lines for a certain color are scanned less frequently than scanning signal lines for other color(s). However, as shown in FIG. 18, the display device 1 of Embodiment 5 is different from the display device 1 of Embodiment 1 in terms of how colors to be displayed in pixels are arranged. Therefore, in consideration of such a difference, the display device 1 of Embodiment 5 is configured such that different scanning signal lines from those in the display device 1 of Embodiment 1 are scanned less frequently. Specifically, in Embodiment 5, scanning signal lines Grb for driving pixel rows Grb are scanned less frequently than scanning signal lines Gwg for driving pixel rows Gwg.

For example, as shown in FIG. 19, during an even-numbered frame period, the scanning line drive circuit 4 carries out scanning of both the scanning signal lines Grb and the scanning signal lines Gwg. On the other hand, as shown in FIG. 20, during an odd-numbered frame period, the scanning line drive circuit 4 (i) carries out scanning of the scanning signal lines Gwg in the same manner as in the even-numbered frame period but (ii) does not carry out scanning of the scanning signal lines Grb. That is, there are provided non-scanning periods during which the scanning signal lines Grb are not scanned. Since the display device 1 of Embodiment 5 is configured as above, in the display device 1, the scanning signal lines Grb are scanned half as frequently as the scanning signal lines Gwg. Since a refresh rate for the scanning signal lines Gwg in the display device 1 of Embodiment 5 is 60 Hz, a refresh rate for the scanning signal lines Grb is 30 Hz.

The display device 1 of Embodiment 5 is the same as the display device 1 of Embodiment 1 in that it carries out a control such that the timing controller 10 supplies, to the scanning signal drive circuit 4, a gate output control signal GOE whose level is kept at high level to thereby cause the scanning line drive circuit 4 not to carry out scanning during the non-scanning periods. Furthermore, the display device 1 of Embodiment 5 is the same as the display device 1 of Embodiment 1 also in that the signal line drive circuit 6 is stopped or performance of the signal line drive circuit 6 is reduced during the non-scanning periods.

(Power-Saving Effect)

The following description will discuss a power-saving effect brought about by the display device 1 of Embodiment 5. Similarly to Embodiment 1, the following description deals with an example in which a resolution of the display device 1 is 1366×768.

First, the following describes how much power is consumed when the display device 1 is caused to carry out a conventional display operation described with reference to FIG. 2. In this case, as described in Embodiment 1, power consumed by the signal line drive circuit 6 is approximately 88 mW, and power consumed by the scanning line drive circuit 4 is approximately 8.1 mW.

Next, the following describes power consumed by the display device 1 in a case where the display device 1 is caused to carry out a display operation in accordance with Embodiment 5 of the present invention as described with reference to FIGS. 10 and 20.

As described earlier, the display device 1 of Embodiment 5 is configured such that the scanning line drive circuit 4 and the signal line drive circuit 6 are in the non-operation state during non-scanning periods during which the scanning signal line Grb are not scanned. The non-scanning periods account for one half of all the horizontal scanning periods included in one half of all the frame periods.

This reduces power consumed by the signal line drive circuit 6 by 88 mW×½×½=22 mW. That is, power consumed by the signal line drive circuit 6 is 88 mW−22 mW=66 mW. In this way, the display device 1 of the present embodiment achieves power saving of approximately 25% in the signal line drive circuit 6.

Similarly, power consumed by the scanning line drive circuit 4 is reduced by 8.1 mW×½×½=2.1 mW. That is, power consumed by the scanning line drive circuit 4 is 8.1 mW−2.1 mW=6.0 mW. In this way, the display device 1 of the present embodiment achieves power saving of approximately 26% in the scanning line drive circuit 4.

(Operation and Effect)

As described above, the display device 1 of Embodiment 5 is configured such that, among a plurality of scanning signal lines G, scanning signal lines for displaying certain colors are scanned less frequently than scanning signal lines for displaying other color(s). Since the display device 1 of Embodiment 5 is configured like above, the display device 1 even more reduces power consumption than a display device that does not employ such a configuration, as described above. Furthermore, flicker (flickering) on a screen is less likely to occur and moving images are displayed more smoothly than a conventional display device configured such that all the scanning signal lines are scanned less frequently. That is, according to the display device 1 of Embodiment 5, it is possible to reduce power consumption while maintaining a high quality of moving images.

In particular, the display device 1 of Embodiment 5 is configured such that the scanning signal lines Grb for displaying blue and red (blue (B) and red (R) have lower luminance ratio than green (G) and white (W)) are scanned less frequently. According to the display device 1 of Embodiment 5 configured like above, less luminance change occurs and thus flicker (flickering) on a screen is less likely to occur, as compared to a display device configured such that scanning signal lines for displaying a color(s) other than blue and red are scanned less frequently. Furthermore, awkward movement of a moving image, which results from a reduction in the number of times scanning is carried out, is less perceivable by a viewer. That is, according to the display device 1 of Embodiment 5, it is possible to reduce power consumption while maintaining a high quality of moving images.

MODIFIED EXAMPLES

The present invention is not limited to the descriptions of the foregoing embodiments, but may be altered within the scope of the claims. That is, an embodiment derived from a combination of technical means properly altered within the scope of the claims is also encompassed in the technical scope of the present invention.

That is, a display device of the present invention is not limited to those described in the foregoing embodiments, provided that the display device realizes at least the function "among a plurality of scanning signal lines, scanning signal lines for displaying a certain color(s) are scanned less frequently than scanning signal lines for displaying other color(s)" by any constituent(s). Therefore, the configurations of the display devices described in the embodiments and/or the display operations carried out by the display devices can be altered in various manners.

Modified Example 1

Scanning Signal Lines to be Scanned Less Frequency

According to Embodiments 1, 3, and 4, scanning signal lines for driving blue pixels are scanned less frequently. Note, however, that it is also possible to employ a configuration in which scanning signal lines for driving pixels of other color(s) are scanned less frequently. For example, in any of Embodiments 1, 3, and 4, scanning signal lines for driving red or green pixels can be caused to be scanned less frequently.

According to Embodiment 2, scanning signal lines for driving blue pixels and scanning signal lines for driving red pixels are scanned less frequently. Note, however, that it is also possible to employ a configuration in which scanning signal lines for driving pixels of other color(s) are scanned less frequently. For example, in Embodiment 2, scanning signal lines for driving blue pixels and scanning signal lines for driving green pixels can be caused to be scanned less frequently. Alternatively, the scanning signal lines for driving red pixels and the scanning signal lines for driving the green pixels can be caused to be scanned less frequently.

According to Embodiment 5, scanning signal lines, each of which is for driving blue and red pixels are scanned less frequently. Note, however, that it is also possible to employ a configuration in which scanning signal lines, each of which is for driving pixels for other color(s), are scanned less frequently. For example, in Embodiment 5, scanning signal lines, each of which is for driving white and green pixels, can be caused to be scanned less frequently.

According to Embodiments 1 through 3, and 5, all of a plurality of scanning signal lines for driving pixels of a certain color(s) are scanned less frequently. Note, however, that it is also possible to employ a configuration in which part of the plurality of scanning signal lines for driving the pixels of the certain color(s) are scanned less frequently. For example, in Embodiment 1, a plurality of scanning signal lines Gb for driving blue pixels are all scanned less frequently. However, Embodiment 1 can be modified such that part of the plurality of scanning signal lines Gb are scanned less frequently.

According to Embodiment 4, a plurality of scanning signal lines for driving pixels of a certain color(s) in a region of a screen are all scanned less frequently. Note, however, that it is also possible to employ a configuration in which part of the plurality of scanning signal lines for driving the pixels of the certain color(s) in the region of the screen are scanned less frequently. For example, in Embodiment 4, all of the scanning signal lines Gb are scanned less frequently. However, part of the scanning signal lines Gb can be caused to be scanned less frequently.

In any of the foregoing cases, it is possible to reduce the amount of operation of at least the scanning line drive circuit 4, thereby achieving power saving. Furthermore, since not all the scanning signal lines for all the colors are scanned less frequently, it is possible to maintain a display quality of moving images as compared to a configuration in which scanning signal lines for all the colors are scanned less frequently.

Note that, besides the foregoing arrangements, there is a variety of arrangements of colors to be displayed in pixels in a display panel. In any case, it is only necessary that scanning signal lines for driving pixels of an appropriate color(s) be scanned less frequently according to how colors of pixels are arranged in the display panel.

Modified Example 2

Reducing Performance of Scanning Signal Line Drive Circuit

According to Embodiments 1 through 5, the signal line drive circuit 6 is in a non-operating state during non-scanning periods. This does not imply any limitation. The signal line drive circuit 6 can be in an operating state. Also in this case, it is possible to reduce the amount of operation of at least the scanning line drive circuit 4, thereby achieving power saving. Note that, in a case where the signal line drive circuit 6 is in the operating state, it is preferable that at least performance of the signal line drive circuit 6 is reduced. This makes it possible to further reduce power consumption.

According to each of the foregoing embodiments, the analog amplifiers included in the signal line drive circuit 6 are caused to be in a non-operating state during non-scanning periods. However, it is only necessary that at least one of the analog amplifiers be in the non-operating state. Even in this case, it is possible to achieve some degree of power-saving effect.

Furthermore, what are to be placed in the non-operating state during non-scanning periods are not limited to the analog amplifiers. That is, performance of a set of circuits (a set of elements) including the analog amplifiers in which constant electric current flows can be reduced. Such a set of circuits is, for example, a digital-analog converter (DAC)

circuit section for determining a voltage for each gray level or a Vdd generating circuit section.

CONCLUSION

As has been described, a display device in accordance with the present invention includes: a display panel having a plurality of scanning signal lines and a plurality of data signal lines; a scanning line drive circuit for sequentially selecting the plurality of scanning signal lines so as to scan the plurality of scanning signal lines; and a signal line drive circuit for supplying data signals, via the plurality of data signal lines, to pixels corresponding to a selected one of the plurality of scanning signal lines, the plurality of scanning signal lines including scanning signal lines for displaying a first certain color and scanning signal lines for displaying other color(s), and a first scanning signal line, which is at least one of the scanning signal lines for displaying the first certain color, being scanned less frequently per unit time than the scanning signal lines for displaying the other color(s).

According to this configuration, since the scanning line drive circuit operates less frequently, the scanning line drive circuit consumes less electric current. Furthermore, according to the configuration, only the scanning signal lines for displaying a certain color(s), instead of all the scanning signal lines, are scanned less frequently. Therefore, flicker (flickering) on a screen is less likely to occur, and moving images can be displayed smoothly. That is, it is possible to reduce power consumption while maintaining a high quality of moving images.

The display device in accordance with the present invention is preferably configured such that the first scanning signal line is a scanning signal line for driving a row of pixels for displaying blue.

According to this configuration, since the scanning signal lines for displaying blue (blue has a lower luminance ratio) are scanned less frequently, this causes only a small change in luminance and thus flicker (flickering) on a screen is less likely to occur. Furthermore, awkward movement of a moving image, which results from a reduction in the number of times scanning is carried out, is less perceivable by a viewer. That is, according to the configuration, it is possible to reduce power consumption while maintaining a high quality of moving images.

The display device in accordance with the present invention is preferably configured such that the first scanning signal line is a scanning signal line for driving a row of pixels including a pixel(s) for displaying blue and a pixel(s) for displaying red.

According to this configuration, since a scanning signal line(s) for displaying blue and red (blue and red have lower luminance ratio) is/are scanned less frequently, this causes only a small change in luminance and thus flicker (flickering) on a screen is less likely to occur. Furthermore, awkward movement of a moving image, which results from a reduction in the number of times scanning is carried out, is less perceivable by a viewer. That is, according to the configuration, it is possible to reduce power consumption while maintaining a high quality of moving images.

The display device in accordance with the present invention is preferably configured such that the first scanning signal line is caused to be scanned less frequently than the scanning signal lines for displaying the other color(s) by providing a frame period in which (i) the scanning signal lines for displaying the other color(s) are scanned but (ii) the first scanning signal line is not scanned.

According to this configuration, it is possible to cause the scanning signal lines to be scanned less frequently, merely by employing a simple configuration in which waveforms of control signals for scanning the scanning signal lines to be scanned less frequently are different from waveforms of control signals for scanning the other scanning signal lines. This makes it possible to achieve the configuration in which the scanning signal lines are scanned less frequently at a lower cost than other configurations such as a configuration in which frame periods for the scanning signal lines to be scanned less frequently are different in length from those for the other scanning signal lines.

The display device in accordance with the present invention is preferably configured such that the first scanning signal line is driven, except during the frame period in which it is not scanned, such that its polarity is reversed for every certain number of frame period(s).

According to this configuration, a voltage applied to each of pixel electrodes corresponding to the scanning signal lines which are scanned less frequently is not constant. This prevents occurrence of problems such as image sticking.

The display device in accordance with the present invention is preferably configured such that during a horizontal scanning period in which the first scanning signal line is not scanned, performance of the signal line drive circuit is reduced.

According to this configuration, it is possible to further reduce power consumption without affecting a quality of moving images.

The display device in accordance with the present invention is preferably configured such that the scanning signal lines for displaying the other colors include scanning signal lines for displaying a second certain color and scanning signal lines for displaying the rest of the other color(s); and a second scanning signal line, which is at least one of the scanning signal lines for displaying the second certain color, is scanned less frequently per unit time than the scanning signal lines for displaying the rest of the other color(s).

According to this configuration, since the scanning line drive circuit operates even less frequently, the scanning line drive circuit consumes even less electric current. Furthermore, according to the configuration, only the scanning signal lines for displaying a certain color(s), instead of all the scanning signal lines, are scanned less frequently. Therefore, flicker (flickering) on a screen is less likely to occur, and moving images can be displayed smoothly. That is, it is possible to reduce power consumption while maintaining a high quality of moving images.

The display device of the present invention is preferably configured such that the display panel has a plurality of display regions; and in part of the plurality of display regions, the first scanning signal line is scanned less frequently per unit time than the scanning signal lines for displaying the other color(s).

According to this configuration, it is possible to select, for each of the plurality of display regions, whether to (i) give priority to a high image quality by not reducing the number of times the scanning signal lines are scanned or (ii) give priority to power saving by reducing the number of times the scanning signal lines are scanned. That is, it is possible to realize well-balanced high image quality and power saving.

A driving method in accordance with the present invention is a method for driving a display device, the display device including (i) a display panel having a plurality of scanning signal lines and a plurality of data signal lines, (ii) a scanning line drive circuit for sequentially selecting the plurality of scanning signal lines so as to scan the plurality of scanning signal lines, and (iii) a signal line drive circuit for supplying data signals, via the plurality of data signal lines, to pixels corresponding to a selected one of the plurality of scanning signal lines, said method including: scanning the plurality of scanning signal lines, which include scanning signal lines for displaying a first certain color and scanning signal lines for displaying other color(s), such that a first scanning signal line, which is at least one of the scanning signal lines for displaying the first certain color, is scanned less frequently per unit time than the scanning signal lines for displaying the other color(s).

According to this arrangement, since the scanning line drive circuit operates less frequently, the scanning line drive circuit consumes less electric current. Furthermore, according to the arrangement, only the scanning signal lines for displaying a certain color(s), instead of all the scanning signal lines, are scanned less frequently. Therefore, flicker (flickering) on a screen is less likely to occur, and moving images can be displayed smoothly. That is, it is possible to reduce power consumption while maintaining a high quality of moving images.

INDUSTRIAL APPLICABILITY

A display device in accordance with the present invention can be widely applicable to various display devices such as a liquid crystal display device, an organic EL display device, and electronic paper.

REFERENCE SIGNS LIST

1 Display Device
2 Display Panel
4 Scanning Line Drive Circuit
6 Signal Line Drive Circuit
8 Common Electrode Drive Circuit
10 Timing Controller

The invention claimed is:

1. A display device, comprising:
a display panel including a plurality of scanning signal lines and a plurality of data signal lines;
a scanning line drive circuit that sequentially selects the plurality of scanning signal lines so as to scan the plurality of scanning signal lines; and
a signal line drive circuit that supplies data signals, via the plurality of data signal lines, to pixels corresponding to a selected one of the plurality of scanning signal lines,
the plurality of scanning signal lines including scanning signal lines that display a first certain color and scanning signal lines that display other colors, and
a first scanning signal line, which is at least one of the scanning signal lines that display the first certain color, is not scanned in all display periods of the display device and the scanning signal lines that display at least one of the other colors are scanned in all of the display periods of the display device.

2. The display device according to claim 1, wherein the first scanning signal line is a scanning signal line that drives a row of pixels to display blue.

3. The display device according to claim 1, wherein the first scanning signal line is a scanning signal line that drives a row of pixels including pixels that display blue and pixels that display red.

4. The display device according to claim 1, wherein the first scanning signal line is caused to be scanned in only some of the display periods by providing a frame period in which (i) the scanning signal lines that display the other colors are scanned but (ii) the first scanning signal line is not scanned.

5. The display device according to claim 4, wherein the first scanning signal line is driven, except during the frame period in which it is not scanned, such that its polarity is reversed for every certain number of frame periods.

6. The display device according to claim 1, wherein, the signal line drive circuit includes analog amplifiers and, during a horizontal scanning period in which the first scanning signal line is not scanned, the analog amplifiers are not operated.

7. The display device according to claim 1, wherein:
the scanning signal lines that display the other colors include scanning signal lines that display a second certain color and scanning signal lines that display the rest of the other colors; and
a second scanning signal line, which is at least one of the scanning signal lines that display the second certain color, is scanned less frequently per unit time than the scanning signal lines that display the rest of the other colors.

8. The display device according to claim 7, wherein:
the first scanning signal line is not scanned during a frame period that comes every two frame periods; and
the second scanning signal line is not scanned during a frame period that comes every three frame periods.

9. The display device according to claim 1, wherein:
the display panel includes a plurality of display regions; and
in only a portion of the plurality of display regions, the first scanning signal line is not scanned in all of the display periods of the display device and the scanning signal lines that display the at least one of the other colors are scanned in all of the display periods of the display device.

10. The display device according to claim 1, wherein:
the pixels include three different colors of pixels; and
ones of the pixels which have a same color are arranged in same rows of the pixels.

11. The display device according to claim 1, wherein:
the pixels include four different colors of pixels;
ones of the pixels having a first two of the four colors are arranged in same rows of the pixels; and
other ones of the pixels having a second two of the four colors are arranged in same other rows of the pixels.

12. The display device according to claim 11, wherein the first scanning signal line is caused to be scanned in only some of the display periods by providing a frame period in which (i) the scanning signal lines that display the other colors are scanned but (ii) the first scanning signal line is not scanned.

13. The display device according to claim 12, wherein the first scanning signal line is driven, except during the frame period in which it is not scanned, such that its polarity is reversed for every certain number of frame periods.

14. The display device according to claim 11, wherein, the signal line drive circuit include analog amplifiers and, during a horizontal scanning period in which the first scanning signal line is not scanned, the analog amplifiers are not operated.

15. The display device according to claim 11, wherein:
the display panel includes a plurality of display regions; and
in only a portion of the plurality of display regions, the first scanning signal line is not scanned in all of the display periods of the display device and the scanning signal lines that display the at least one of the other colors are scanned in all of the display periods of the display device.

16. A method for driving a display device, the display device including (i) a display panel including a plurality of scanning signal lines and a plurality of data signal lines, (ii) a scanning line drive circuit that sequentially selects the plurality of scanning signal lines so as to scan the plurality of scanning signal lines, and (iii) a signal line drive circuit that supplies data signals, via the plurality of data signal lines, to pixels corresponding to a selected one of the plurality of scanning signal lines, said method comprising:

scanning the plurality of scanning signal lines, which include scanning signal lines that display a first certain color and scanning signal lines that display other colors, such that a first scanning signal line, which is at least one of the scanning signal lines that display the first certain color, is not scanned in all display periods of the display device and the scanning signal lines that display at least one of the other colors are scanned in all of the display periods of the display device.

* * * * *